US007372193B2

(12) United States Patent
Hirokado

(10) Patent No.: US 7,372,193 B2
(45) Date of Patent: May 13, 2008

(54) COLD CATHODE LIGHT EMITTING DEVICE WITH NANO-FIBER STRUCTURE LAYER, MANUFACTURING METHOD THEREOF AND IMAGE DISPLAY

(75) Inventor: Yoshinobu Hirokado, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 130 days.

(21) Appl. No.: 10/811,980

(22) Filed: Mar. 30, 2004

(65) Prior Publication Data

US 2004/0201345 A1 Oct. 14, 2004

(30) Foreign Application Priority Data

Apr. 8, 2003 (JP) ..... 2003-104161

(51) Int. Cl.
*H01J 1/304* (2006.01)

(52) U.S. Cl. ..... 313/310; 313/311

(58) Field of Classification Search ..... 313/309–311, 313/495–497

See application file for complete search history.

(56) References Cited

U.S. PATENT DOCUMENTS

| | | | | |
|---|---|---|---|---|
| 5,229,331 | A * | 7/1993 | Doan et al. | 438/20 |
| 5,683,282 | A * | 11/1997 | Liu et al. | 445/50 |
| 5,817,201 | A | 10/1998 | Greschner et al. | |
| 5,929,560 | A * | 7/1999 | Trujillo et al. | 313/495 |
| 5,955,850 | A * | 9/1999 | Yamaguchi et al. | 313/495 |
| 6,075,315 | A * | 6/2000 | Seko et al. | 313/336 |
| 6,211,608 | B1 * | 4/2001 | Raina et al. | 313/309 |
| 6,369,596 | B1 * | 4/2002 | Anderson | 324/755 |
| 6,489,710 | B1 * | 12/2002 | Okita et al. | 313/309 |
| 6,515,415 | B1 * | 2/2003 | Han et al. | 313/496 |
| 6,534,913 | B1 * | 3/2003 | Perrin et al. | 313/497 |
| 6,680,564 | B2 * | 1/2004 | Tomii | 313/446 |
| 6,686,680 | B2 * | 2/2004 | Shaw et al. | 313/309 |
| 6,771,012 | B2 * | 8/2004 | Ahmed et al. | 313/336 |
| 6,835,947 | B2 * | 12/2004 | Govyadinov et al. | 257/10 |
| 7,012,362 | B2 * | 3/2006 | Kawate et al. | 313/495 |
| 7,056,753 | B2 * | 6/2006 | Lee et al. | 438/20 |
| 7,101,243 | B2 * | 9/2006 | Amey, Jr. | 445/24 |
| 2002/0036452 | A1 * | 3/2002 | Muroyama et al. | 313/310 |

FOREIGN PATENT DOCUMENTS

| | | | |
|---|---|---|---|
| CN | 1396617 | A | 2/2003 |
| JP | 2002-110073 | A | 4/2002 |
| JP | 2003-86082 | A | 3/2003 |

* cited by examiner

*Primary Examiner*—Allen C. Ho
(74) *Attorney, Agent, or Firm*—Birch, Stewart, Kolasch & Birch, LLP

(57) ABSTRACT

A cold cathode light emitting device includes a plurality of first electrodes, a plurality of insulating layers, a plurality of second electrodes and a third electrode. The insulating layers are laminated on the first electrodes. The second electrodes are provided on the insulating layers to intersect the first electrodes. The third electrode emits light upon receipt of electrons. At least one hole is provided at intersections of the first electrodes and second electrodes. The hole has a first diameter d1 at a position where the insulating layers are in contact with the first electrodes and a second diameter d2 at a position where the insulating layers are in contact with the second electrodes, where d1 is smaller than d2. A nanofiber-structure layer is formed on the first electrodes in an opening portion having the first diameter d1, provided in the at least one hole on the side of the first electrodes.

3 Claims, 24 Drawing Sheets

COLD CATHODE LIGHT EMITTING DEVICE WITH NANO-FIBER STRUCTURE LAYER, MANUFACTURING METHOD THEREOF AND IMAGE DISPLAY

BACKGROUND OF THE INVENTION

1. Field of the Invention

The present invention relates to a flat panel display, and more particularly to a field emission display which uses light emitting devices for its screen in which such light emitting devices have, as electron sources, cold cathodes formed of carbon nanotube (hereinafter abbreviated to CNT), graphite nanofiber (hereinafter abbreviated to GNF) or the like.

2. Description of the Background Art

Among conventional cold cathode light emitting devices using a nanostructure material on a nanometric scale such as CNT as a field emission source and manufacturing methods thereof is one that is described in, for example, Japanese Patent Laid-Open No. 2002-110073 (cf. FIG. 1 & paragraph [0014]). This document discloses forming openings to be filled with a nanostructure material by a usual photolithography process, a dry process and the like, and thereafter forming a CNT-containing film with its film thickness limited to several tens of microns at desired positions on the surface of cathode electrodes by an ink jet process or the like.

The above conventional technique may cause a technical problem when filling openings provided at desired positions on the surface of cathode electrodes (or first electrodes) with a CNT-containing film by an ink jet process or the like. That is, the CNT-containing film may spill out from the openings depending on conditions for filling the CNT-containing film (e.g., pressure at filling, variations in viscosity, displacement of filling position, etc). Since spilled part of the CNT-containing film creates a short circuit between the cathode electrodes (or first electrodes) and gate electrodes (or second electrodes), these electrodes are likely to become shorted to each other.

SUMMARY OF THE INVENTION

An object of the present invention is to provide a cold cathode light emitting device capable of easily preventing shorting of cathode electrodes and gate electrodes, and a technique related thereto.

Another object of the present invention is to provide a cold cathode light emitting device capable of easily controlling the thickness of a nanofiber-structure layer containing a nanofiber-structure material formed in gate holes and is suitable for manufacture of large screen displays, and a technique related thereto.

A first aspect of the present invention is directed to the cold cathode light emitting device emitting light by electrons extracted from a cold cathode. The cold cathode light emitting device includes a plurality of first electrodes, a plurality of insulating layers laminated in the plurality of first electrodes, a plurality of second electrodes provided on the plurality of insulating layers to intersect the plurality of first electrodes with the plurality of insulating layers interposed therebetween, for extracting electrons from the plurality of first electrodes, and a third electrode opposed to the plurality of second electrodes for emitting light upon receipt of the electrons, with a voltage for accelerating the electrons being applied between the third electrode and the plurality of first electrodes. At least one hole is provided at intersections of the plurality of first electrodes and the plurality of second electrodes to extend through the plurality of second electrodes and the plurality of insulating layers to reach a surface of the plurality of first electrodes. The at least one hole has a first diameter d1 at a position where the plurality of insulating layers are in contact with the plurality of first electrodes and a second diameter d2 at a position where the plurality of insulating layers are in contact with the plurality of second electrodes, where d2 is greater than d1. A nanofiber-structure layer is provided on the plurality of first electrodes in an opening portion having the first diameter d1 in the at least one hole.

The distance between cathode electrodes (first electrodes) and nanofiber-structure layer and gate electrodes (second electrodes) can be increased while controlling the whole thicknesses of the plurality of insulating layers. This can easily prevent the nanofiber-structure layer and gate electrodes from contacting each other in a thermal processing step and the like among component forming steps.

Further, since the lowermost insulating layer of the plurality of insulating layers functions as a guide for defining the film thickness and position of the nanofiber-structure layer, the nanofiber-structure layer can easily be controlled in film thickness and position and can be formed in uniform thickness.

According to a second aspect of the invention, a method of manufacturing the above-described cold cathode light emitting device includes the following steps (a) and (b). The step (a) is to coat a solvent containing a nanofiber-structure material dispersed therein on a surface of a substrate having the at least one hole formed therein, and drying the solvent to form a dried film. The step (b) is to spray polishing particles at a high pressure onto a surface of the dried film containing the nanofiber-structure material to remove an unnecessary part of the dried film.

Setting the particle diameter of the polishing particles used for removing the unnecessary part of the dried film remaining in the hole at an appropriate value facilitates the removal of the unnecessary part of the dried film.

According to a third aspect of the invention, a method of manufacturing the above-described cold cathode light emitting device includes the following steps (a) to (d). The step (a) is to form the at least one hole in the plurality of second electrodes and the plurality of insulating layers and forming a sacrificial layer which covers the plurality of second electrodes except a portion corresponding to the at least one hole. The step (b) is to coat a solvent containing a nanofiber-structure material dispersed therein on an inner surface of the at least one hole and on a surface of the sacrificial layer, and drying the solvent to form a dried film. The step (c) is to spray polishing particles at a high pressure onto a surface of the dried film containing the nanofiber-structure material to remove an unnecessary part of the dried film. The step (d) is to remove the sacrificial layer.

Setting the particle diameter of the polishing particles used for removing the unnecessary part of the dried film remaining in the hole at an appropriate value facilitates the removal of the unnecessary part of the dried film.

Further, it is possible to prevent the dried film from adhering to a region other than in the hole as well as to prevent damage to the gate electrodes and the like by the polishing particles at the removal of the unnecessary part of the dried film.

According to a fourth aspect of the invention, a method of manufacturing the above-described cold cathode light emitting device includes the following steps (a) to (d). The step (a) is to form a lowermost insulating layer of the plurality of insulating layers on the plurality of first electrodes. The step (b) is to selectively remove the lowermost insulating layer to form the opening portion which constitutes a lower part of the at least one hole on the side of the plurality of first electrodes. The step (c) is to coat a solvent containing a nanofiber-structure material dispersed therein on an inner surface of the opening portion and a surface of the lowermost insulating layer, and drying the solvent to form a dried film. The step (d) is to planarize the dried film containing the nanofiber-structure material to remove the dried film except a part thereof present in the opening portion.

Planarization conducted after formation of the dried film containing the nanofiber-structure material facilitates the removal of the dried film except a part thereof present in the opening portion formed in the lowermost insulating layer.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
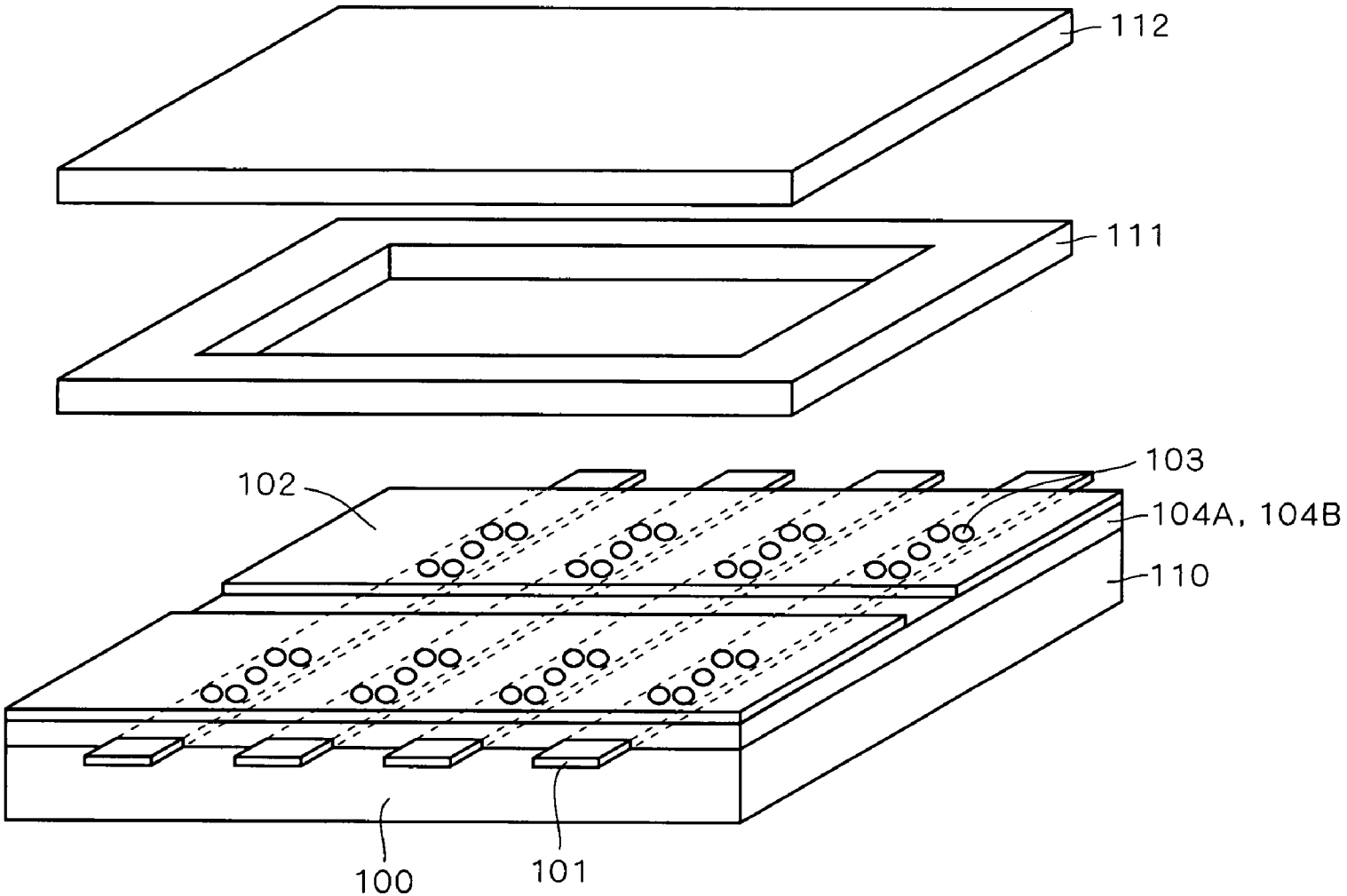
FIG. 1 is a disassembled perspective view schematically showing the construction of a cold cathode light emitting device according to a first preferred embodiment of the present invention.

FIG. 1 is a disassembled perspective view schematically showing the construction of a cold cathode light emitting device according to a first preferred embodiment of the present invention. The cold cathode light emitting device according to the present embodiment is characterized by its cathode substrate structure, and explanation will therefore be focused on the cathode substrate structure.

As shown in FIG. 1, the cold cathode light emitting device of the present embodiment includes a cathode substrate 110 serving as a rear panel provided with an array of electron sources, a phosphor display panel 112 serving as a front panel provided with phosphor stripes or dots at positions that correspond to the electron sources, and a glass frame 111 serving as a spacer. The glass frame 111 is intended for holding and securing the cathode substrate 110 and phosphor display panel 112 at a constant distance, to thereby create a closed space between the cathode substrate 110 and phosphor display panel 112. As the screen size increases, another spacer not shown is required to be provided within the glass frame 111 for holding the cathode substrate 110 and phosphor display panel 112 at a constant distance.

The cathode substrate 110 has a glass substrate 100, a plurality of cathode electrodes 101, a plurality of gate electrodes 102, and a plurality of insulating layers 104A and 104B provided between the cathode electrodes 101 and gate electrodes 102. The cathode electrodes 101 or first electrodes each have substantially a strip shape and are arranged at a pitch on the glass substrate 100 in parallel to one another. The gate electrodes 102 or second electrodes are intended for extracting electrons from the cathode electrodes 101 and each have substantially a strip shape. The gate electrodes 102 are arranged at a pitch in parallel to one another so as to intersect the cathode electrodes 101. At least one gate hole 103 filled with an electron source is formed at the intersections of the cathode electrodes 101 and gate electrodes 102.

An anode electrode or third electrode not shown is provided on the inner side of the phosphor display panel 112 that faces the above-mentioned closed space. A voltage for accelerating electrons extracted from the electron sources is applied between this anode electrode and cathode electrodes 101, and incoming electrons cause the anode electrode to emit light.

Inputting a scanning signal and an image signal to the cathode electrodes 101 and gate electrodes 102, respectively, and applying an accelerating voltage between the cathode electrodes 101 and the above-mentioned anode electrode causes the anode electrode to emit light, so that an image is displayed.

Figure 2A:
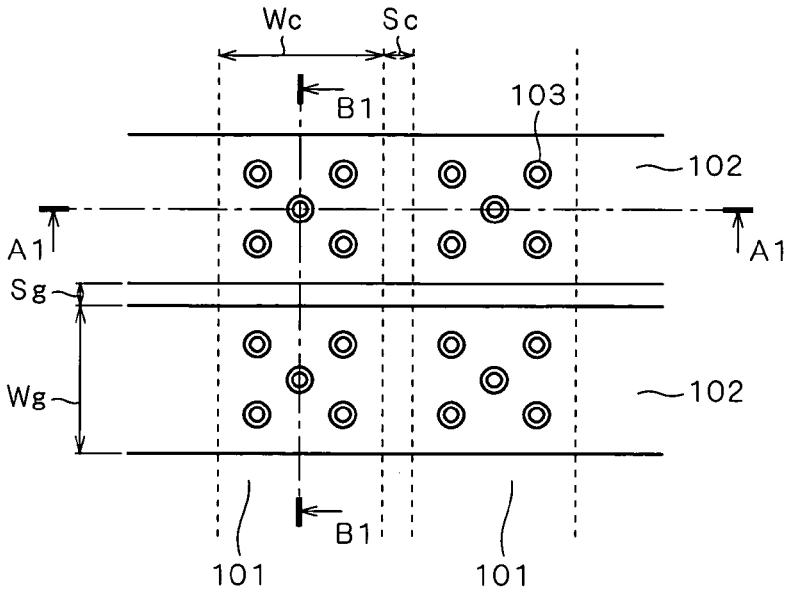
FIG. 2A is an enlarged plan view of an essential part of a cathode substrate of the cold cathode light emitting device shown in FIG. 1, and FIGS. 2B and 2C are sectional views taken along the lines A1-A1 and B1-B1 of FIG. 2A, respectively.
Figure 2B:
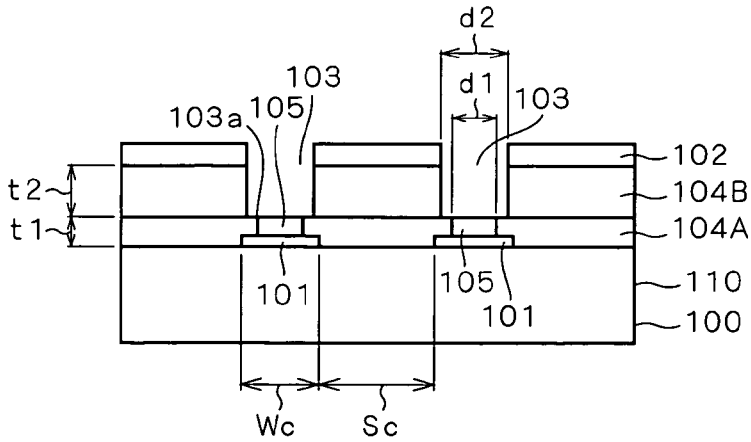
Figure 2C:
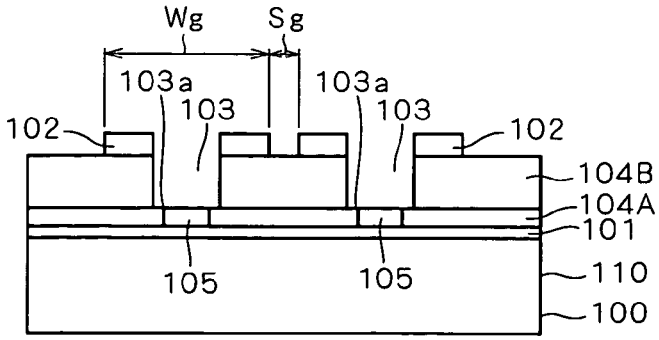

FIG. 2A is an enlarged plan view of an essential part of the cathode substrate 110 of the cold cathode light emitting device shown in FIG. 1. FIGS. 2B and 2C are sectional views taken along the lines A1-A1 and B1-B1 of FIG. 2A, respectively. The construction of the essential part of the cathode substrate 110 will be described first. In the present preferred embodiment, as shown in FIGS. 2A to 2C, the plurality of cathode electrodes 101 are formed in strips on the surface of the glass substrate 100. The cathode electrodes 101 are formed of a metal thin film made of metal, e.g., chromium, each having a width Wc set at, e.g., 200 μm, and a pitch Sc between the cathode electrodes 101 is set at, e.g., 400 μm. The film thickness of the cathode electrodes 101 is set at, e.g., 100 μnm.

Further, in the present embodiment, two insulating layers 104A and 104B are provided. These insulating layers 104A and 104B are each formed by firing a glass paste for insulating layer made of resin with glass powder dispersed therein. Glass powder having a higher softening point is used for the lower insulating layer 104A located adjacent to the cathode electrodes 101 than that for the upper insulating layer 104B. Thickness t1 of the lower insulating layer 104A and thickness t2 of the upper insulating layer 104B are determined to satisfy such a relation that t1<t2. For instance, t1 is set at 6 μm, and t2 is set at 12 μm.

Here, the insulating layer 104B located adjacent to the gate electrodes 102 is set to have a greater thickness than the insulating layer 104A located adjacent to the cathode electrodes 101 so as to perform the function of ensuring insulation between the gate electrodes 102 and the cathode electrodes 101 and a nanofiber-structure layer 105 serving as electron sources which will be described later.

The gate electrodes 102 are formed in strips similarly to the cathode electrodes 101, and are formed of a metal thin film made of metal, e.g., chromium, each having a width Wg set at, e.g., 1.01 mm, and a pitch Sg between the gate electrodes 102 is set at, e.g., 0.1 mm. The film thickness of the gate electrodes 102 is set at, e.g., 200 nm.

The gate holes 103 extend through the gate electrodes 102, insulating layers 104A and 104B at the intersections of the cathode electrodes 101 and gate electrodes 102 to reach the surface of the cathode electrodes 101. The opening of the gate holes 103 may have any shape, but a circular shape is employed in the present embodiment. Here, for description of the inner configuration of a gate hole 103, the gate hole 103 is assumed to be divided into a first section corresponding to the insulating layer 104A, a second section corresponding to the insulating layer 104B and a third section corresponding to the gate electrodes 102. In the present embodiment, a hole diameter d1 of the gate hole 103 in the first section corresponding to the insulating layer 104A and a hole diameter d2 in the second section corresponding to the insulating layer 104B are determined to have such a relation that d1<d2. For instance, d1 is set at 20 μm, and d2 is set at 50 μm. A hole diameter of the gate hole 103 in the third section corresponding to the gate electrodes 102 is set substantially equal to the hole diameter d2 at the upper part of the second section. That is, in the present embodiment, the gate hole 103 is set to have the substantially constant diameter d1 in the first section and the substantially constant diameter d2 in the second and third sections.

The pitch between adjacent gate holes 103 is determined such that the distance between their centers is a predetermined value, e.g., 100 μm.

Formed in a bottom opening portions 103*a* of the gate holes 103 is the nanofiber-structure layer 105 of nanofiber structure containing CNT of nanofiber structure. The nanofiber-structure layer 105 is formed in the first section of the gate holes 103 corresponding to the insulating layer 104A. In other words, the nanofiber-structure layer 105 is formed on the cathode electrodes 101 uncovered at the bottom opening portions 103*a* of the gate holes 103. The nanofiber-structure layer 105 has a thickness substantially equal to a value obtained by subtracting the film thickness of the cathode electrodes 101 from that of the insulating layer 104A.

Figure 3:
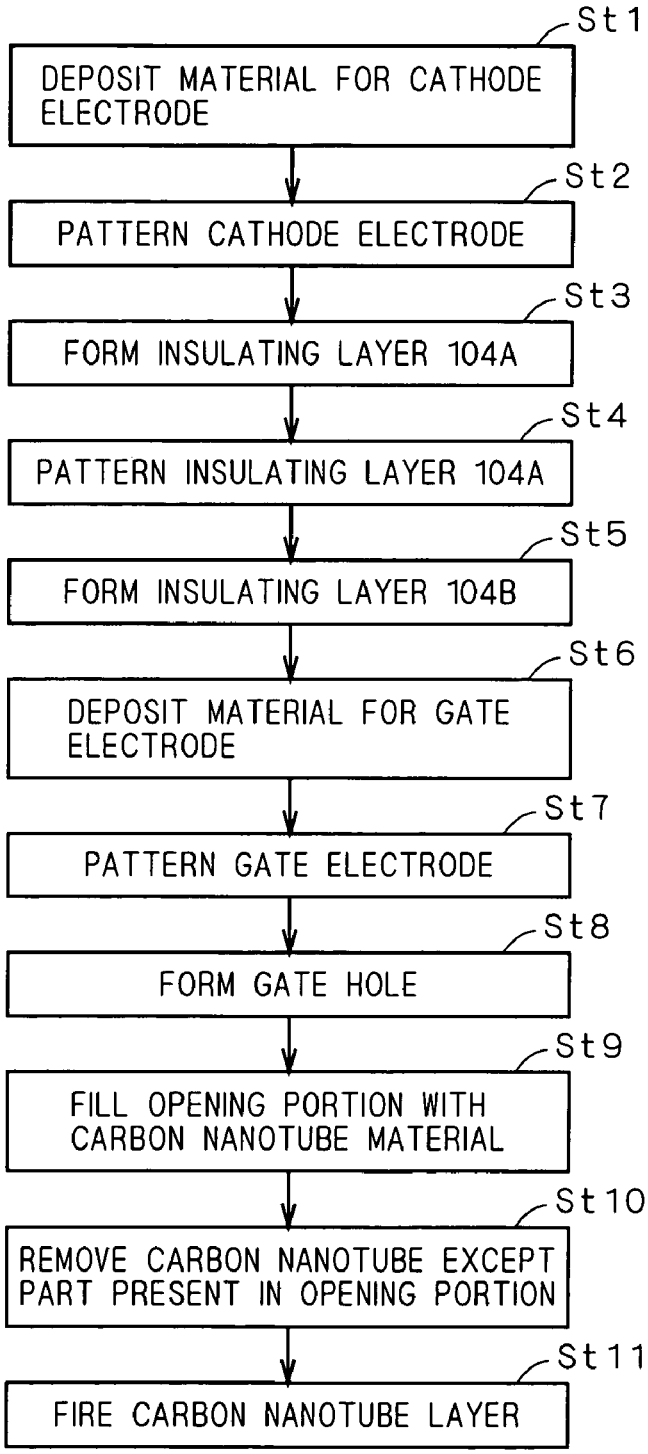
FIG. 3 is a flow chart of manufacturing steps of the cold cathode light emitting device shown in FIGS. 2A to 2C.

FIG. 3 is a flow chart of manufacturing steps of the cold cathode light emitting device shown in FIGS. 2A to 2C. FIGS. 4A through 4G correspond to the cross section taken along the line A1-A1 of FIG. 2A, and show the first half of the manufacturing steps of the cold cathode light emitting device. FIGS. 5A through 5E correspond to the cross section taken along the line A1-A1 of FIG. 2A, and show the latter half of the manufacturing steps of the cold cathode light emitting device. FIGS. 6A through 6G correspond to the cross section taken along the line B1-B1 of FIG. 2A, and show the first half of the manufacturing steps of the cold cathode light emitting device. FIGS. 7A through 7E correspond to the cross section taken along the line B1-B1 of FIG.

2A, and show the latter half of the manufacturing steps of the cold cathode light emitting device.

Figure 4A:
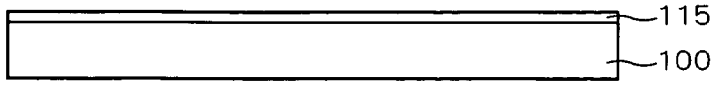
FIGS. 4A through 4G correspond to the cross section taken along the line A1-A1 of FIG. 2A, and show the first half of the manufacturing steps of the cold cathode light emitting device.
Figure 4B:
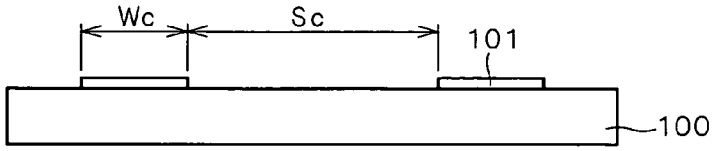
Figure 6A:
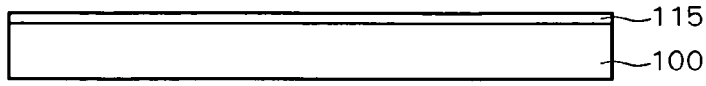
FIGS. 6A through 6G correspond to the cross section taken along the line B1-B1 of FIG. 2A, and show the first half of the manufacturing steps of the cold cathode light emitting device.
Figure 6B:
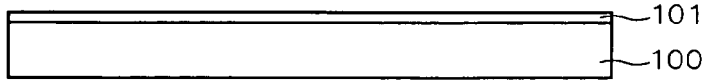

First, a metal thin film 115 made of metal, e.g., chromium is formed on the surface of the glass substrate 100 by sputtering or the like (step St1 in FIG. 3; FIGS. 4A and 6A). Next, the metal thin film 115 is selectively removed by a photolithography process, so that the cathode electrodes 101 are formed (step St2 in FIG. 3; FIGS. 4B and 6B). The photolithography process here means a series of steps including resist coating, drying, exposure, development, etching and resist removal. This applies throughout this specification.

Figure 4C:
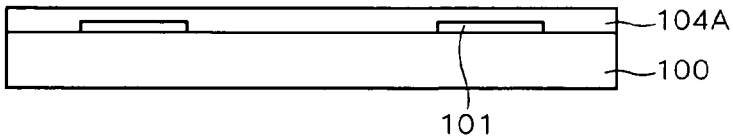
Figure 4D:
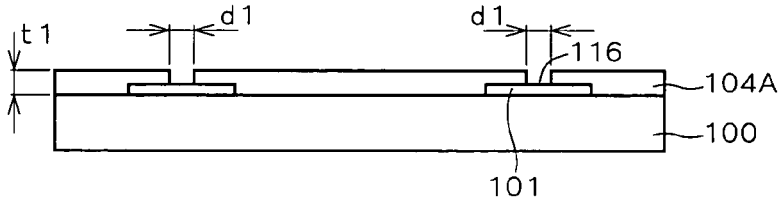
Figure 6C:
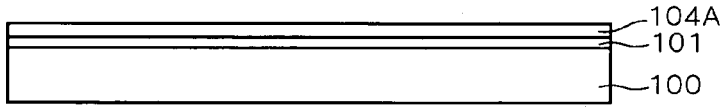
Figure 6D:
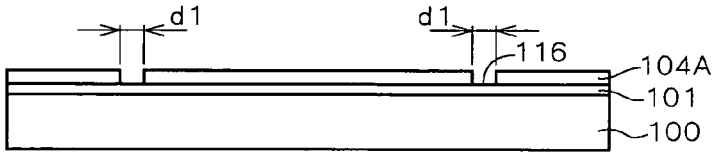

Subsequently, a glass paste for insulating layer is printed on the whole surface of the glass substrate 100 including the cathode electrodes 101. The printed glass paste layer is dried and then fired. The insulating layer 104A is thereby formed (step St3 in FIG. 3; FIGS. 4C and 6C). Next, the insulating layer 104A is selectively removed by the photolithography process, so that hole portions 116 having the diameter d1 for forming the bottom opening portions 103*a* of the gate holes 103 are formed at a predetermined pitch, e.g., 100 μm (step St4 in FIG. 3; FIGS. 4D and 6D).

Figure 4E:
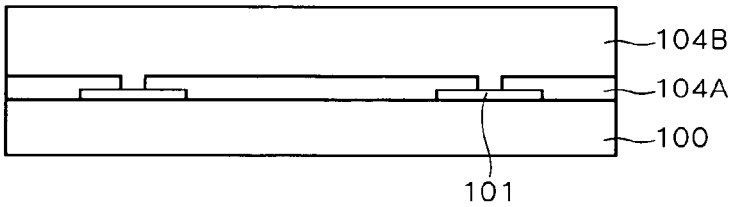
Figure 4F:
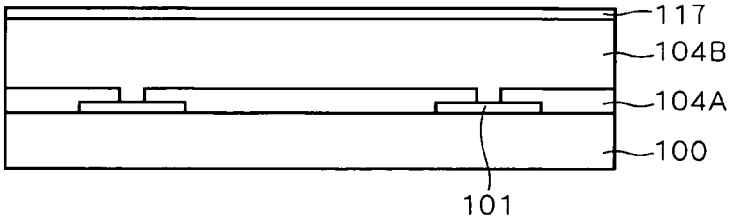
Figure 6E:
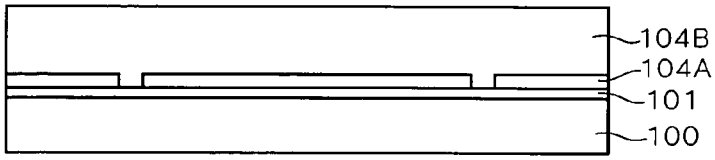
Figure 6F:
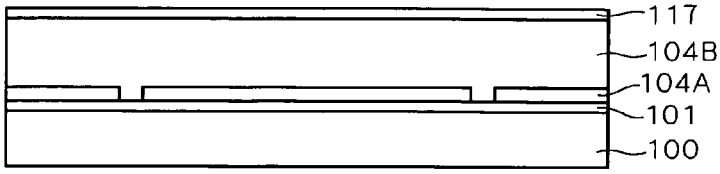

Then, a glass paste for insulating layer is printed on the whole surface of the insulating layer 104A including the hole portions 116. The printed glass paste layer is dried and then fired. The insulating layer 104B is thereby formed (step St5 in FIG. 3; FIGS. 4E and 6E). Since glass powder used for the insulating layer 104B has a lower softening point than that for the insulating layer 104A, the lower insulating layer 104A can be prevented from softening at the firing of the insulating layer 104B. Therefore, it is possible to prevent deformation of the predetermined configuration including the hole portions 116.

Figure 4G:
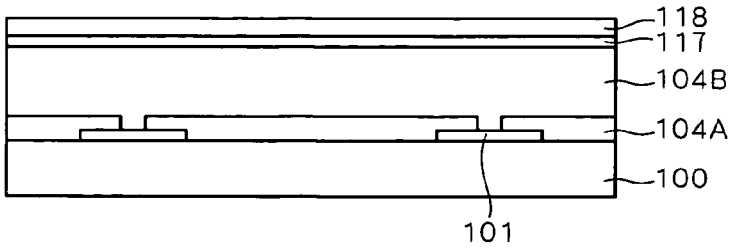
Figure 6G:
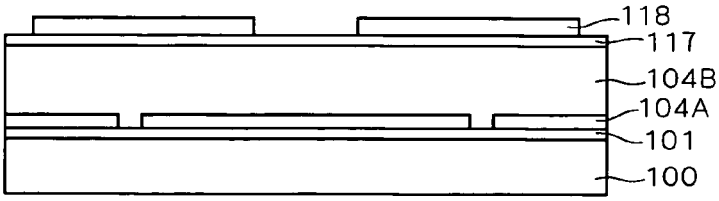

Next, a metal thin film 117 made of metal, e.g., chromium is formed on the and 6F), and is selectively removed by the photolithography process (step St7 in FIG. 3). That is, the metal thin film 117 is patterned using a resist pattern 118 formed on the metal thin film 117 (FIGS. 4G and 6G). The resist pattern 118 is thereafter removed.

Figure 5A:
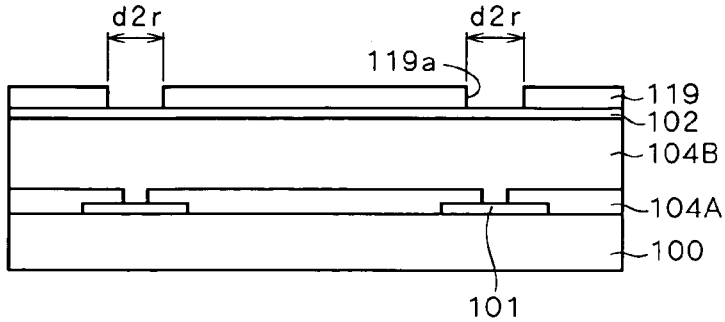
FIGS. 5A through 5E correspond to the cross section taken along the line A1-A1 of FIG. 2A, and show the latter half of the manufacturing steps of the cold cathode light emitting device.
Figure 7A:
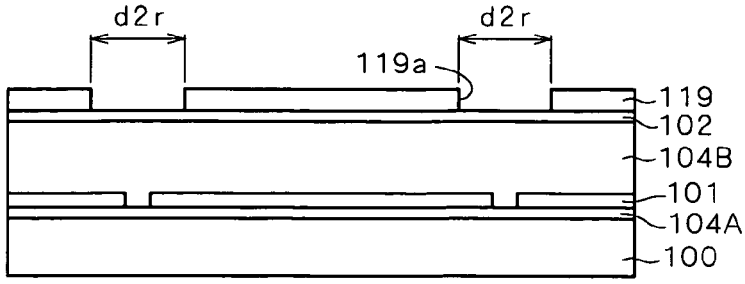
FIGS. 7A through 7E correspond to the cross section taken along the line B1-B1 of FIG. 2A, and show the latter half of the manufacturing steps of the cold cathode light emitting device.

Subsequently, the gate holes 103 are formed (step St8 in FIG. 3). First, a resist pattern 119 for forming gate holes is formed on the surface of the insulating layer 104B with the gate electrodes 102 interposed therebetween (FIGS. 5A and 7A). The resist pattern 119 is used as an etching mask for the gate electrodes 102 and insulating layer 104B, and is provided with hole portions 119*a* for forming gate holes having a diameter d2r, e.g., 50 μm at predetermined positions.

Figure 5B:
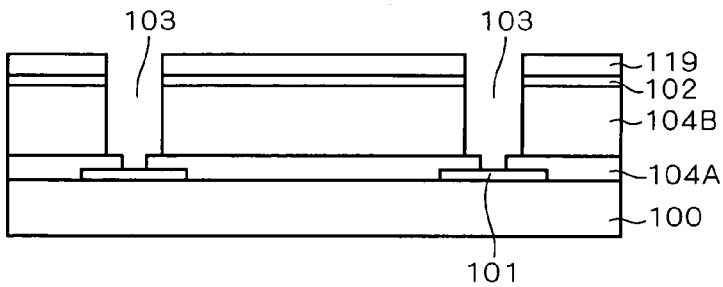
Figure 5C:
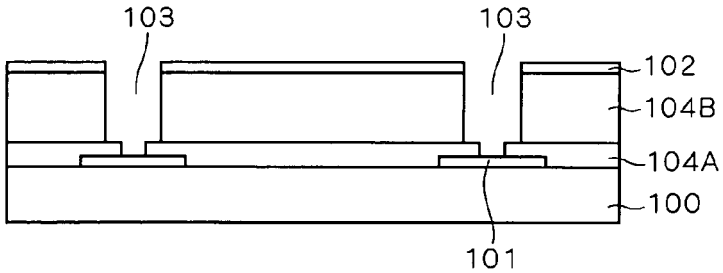
Figure 7B:
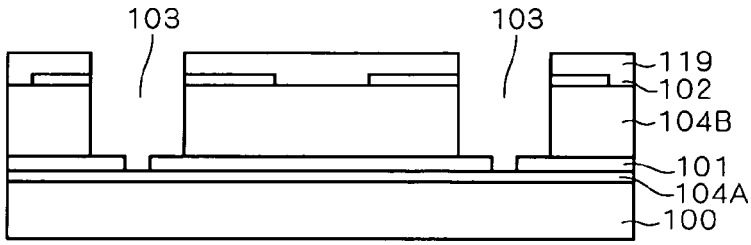
Figure 7C:
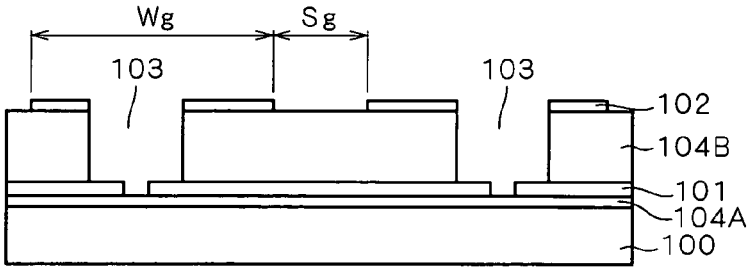

Next, the gate electrodes 102 are subjected to chemical etching with mixed acid through the resist pattern 119, and then the insulating layer 104B is subjected to chemical etching with nitric acid. The gate holes 103 are thereby formed to extend to reach the surface of the cathode electrodes 101 (FIGS. 5B and 7B). The resist pattern 119 is thereafter removed (FIGS. 5C and 7C).

Figure 5D:
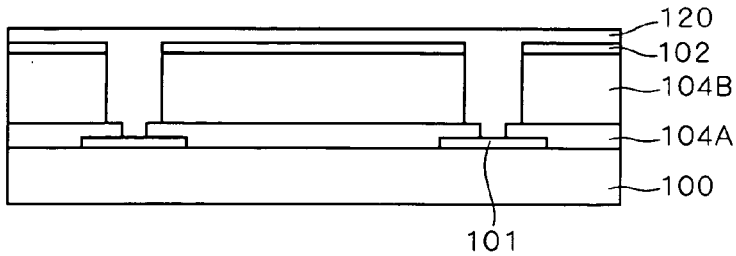
Figure 5E:
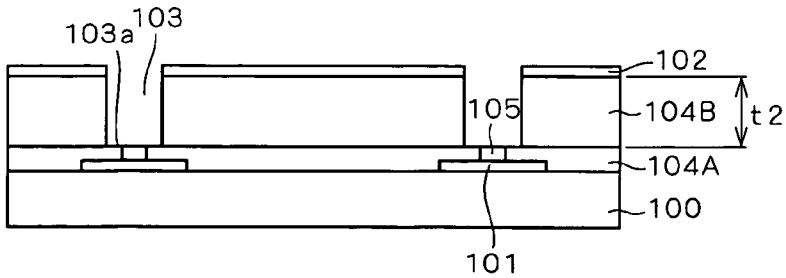
Figure 7D:
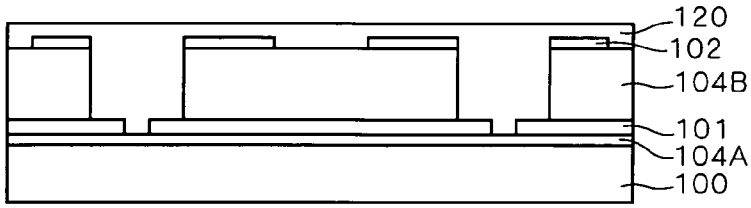
Figure 7E:
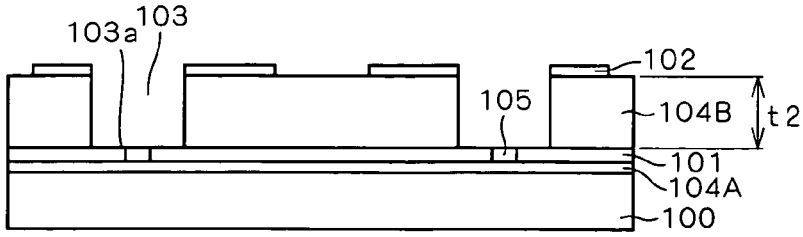

Thereafter, a solvent containing CNTs dispersed therein is sprayed at a high pressure onto the whole surface of the glass substrate 100 including the gate holes 103 for coating, and is then dried (step St9 in FIG. 3; FIGS. 5D and 7D). After the CNT-containing solvent is dried, an unnecessary part of a resultant dried film 120 containing CNTs other than a part thereof present in the bottom opening portions 103*a* of the gate holes 103 is removed by sand blasting (step St10 in FIG. 3; FIGS. 5E and 7E). That is, part of the dried film 120 remaining in the bottom opening portions 103*a* constitutes the nanofiber-structure layer 105 of nanofiber structure. Specifically, calcium carbonate particles as polishing particles are sprayed at a high pressure onto the surface of the dried film 120. The calcium carbonate particles used here have a particle diameter ds satisfying such a relation with the diameters d1 and d2 of the gate holes 103 that d1<ds<d2. Accordingly, the calcium carbonate particles enter the gate holes 103, but do not enter the bottom opening portions 103*a*. As a result, the dried film 120 is removed except the part thereof present in the bottom opening portions 103*a*. The particle diameter ds of the calcium carbonate particles used here ranges between 25 and 30 μm, for example.

After the unnecessary part of the dried film 120 is removed, the nanofiber-structure layer 105 formed in the gate holes 103 is fired at temperatures ranging from 450 to 550° C., for example, so as to be adhered to the cathode electrodes 101 (step St11 in FIG. 3). The cathode substrate 110 shown in FIGS. 2A to 2C is thereby obtained.

The cold cathode light emitting device constructed as described above is used for the screen of a flat panel display.

As described, in the cold cathode light emitting device according to the present embodiment, the diameter d2 of the gate holes 103 at contact positions between the insulating layer 104B and gate electrodes 102 is set greater than the diameter d1 of the gate holes 103 at contact positions of the insulating layer 104A and cathode electrodes 101 (at the bottom opening portions 103*a*), and the nanofiber-structure layer 105 of nanofiber structure is formed in the bottom opening portions 103*a*. Therefore, the distance between the gate electrodes 102 and cathode electrodes 101 and nanofiber-structure layer 105 can be increased while controlling the whole thicknesses of the insulating layers 104A and 104B. This can easily prevent the nanofiber-structure layer 105 provided in the bottom opening portions 103*a* from contacting the gate electrodes 102 in a thermal processing step and the like among component forming steps. Further, since the insulating layer 104A functions as a guide for defining the film thickness and position of the CNT-containing nanofiber-structure layer 105, the nanofiber-structure layer 105 can easily be controlled in film thickness and position, and can be formed in uniform thickness.

Furthermore, the nanofiber-structure layer 105 is formed in the bottom opening portions 103*a* having a diameter smaller than that of the gate holes 103 on the side near the gate electrodes 102. Therefore, when forming the second and third sections of the gate holes 103 located near the gate electrodes 102, a standard of positioning accuracy required for these sections relative to the bottom opening portions 103*a* is relaxed. This suppresses influences caused by dimensional variations of respective components according to thermal history. A cold cathode light emitting device that is easy to manufacture can thus be obtained.

Still further, providing the insulating layer 104B in addition to the insulating layer 104A allows the cathode electrodes 101 and gate electrodes 102 to be kept at a constant distance. This enables stable light emission while preventing shorting of the both electrodes.

Still further, the gate holes 103 are formed in the plurality of laminated insulating layers 104A and 104B. Accordingly, the gate holes 103 can easily be formed with their diameter varying in steps in the order that the insulating layers 104A and 104B are laminated.

Still further, gate operations can be performed at a desired voltage by controlling the respective dimensions of the diameter d1 of the gate holes 103 near the cathode electrodes 101 and the diameter d2 near the gate electrodes 102 and the ratio therebetween, the thickness t1 of the insulating layer 104A and thickness t2 of the insulating layer 104B and the ratio therebetween, and the like.

Still further, the second section of the gate holes 103 corresponding to the insulating layer 104B is formed in a step-less shape with no substantial change in diameter. This can prevent polishing particles from directly colliding with the inner walls of the gate holes 103 defined by the insulating layer 104B to cause damage to the inner walls. Moreover, even in the case where the insulating layer 104B is fired after the formation of the gate holes 103, deformation of the insulating layer 104B by the thermal step makes the gate electrodes 102 difficult to sink into the gate holes 103.

Still further, the insulating layers 104A and 104B are each formed by firing a paste material made of resin with glass powder dispersed therein. Therefore, the insulating layers 104A and 104B can easily be formed without employing a deposition step such as CVD.

Still further, the insulating layer 104B adjacent to the gate electrodes 102 has a greater thickness than the insulating layer 104A adjacent to the cathode electrodes 101. This can reliably ensure insulation between the gate electrodes 102 and cathode electrodes 101 and nanofiber-structure layer 105 while controlling the whole thicknesses of the insulating layers 104A and 104B.

Still further, glass powder used for the insulating layer 104B adjacent to the gate electrodes 102 has a lower softening point than that for the insulating layer 104A. This can prevent the lower insulating layer 104A from softening at the firing of the insulating layer 104B, causing dimensional ununiformity and the like.

Still further, the dried film 120 is formed by, for example, spraying a CNT-containing solution onto the whole surface of the cathode substrate 110 in which the gate holes 103 are already formed, and polishing particles are sprayed onto the dried film 120 for removing the unnecessary part thereof. Accordingly, the removal of the unnecessary part of the dried film 120 filling the gate holes 103 can easily be conducted by setting the particle diameter ds of the polishing particles used for sand blasting at an appropriate value satisfying the relation $d1<ds<d2$.

Still further, in the step of removing the unnecessary part of the dried film 120, the polishing particles collide with the surface of the dried film 120 within the bottom opening portions 103*a*. This advantageously allows the CNTs, which have been directed randomly, to have a certain directivity, achieving improved properties of electron emission from the CNTs.

Although CNT is employed as a nanofiber-structure material in the present embodiment, another material such as GNF may be used. This also applies to the following second to eighth preferred embodiments.

In the present embodiment, the cathode electrodes 101 and gate electrodes 102 are made of chromium, however, any metal material may be used if only it is a conductive material that will not lose conductivity by thermal processing in an electrode forming step. This also applies to the following second to eighth preferred embodiments.

Second Preferred Embodiment

Figure 8A:
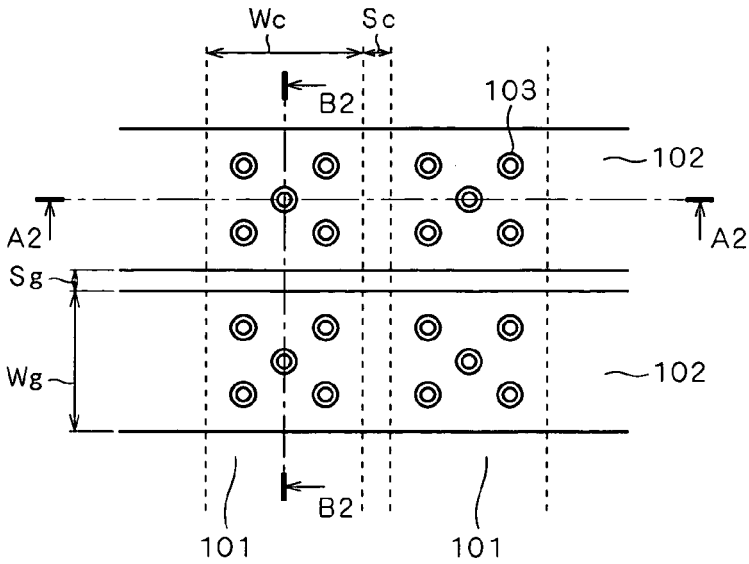
FIG. 8A is an enlarged plan view of an essential part of a cathode substrate of a cold cathode light emitting device according to a second preferred embodiment of the invention.
Figure 8B:
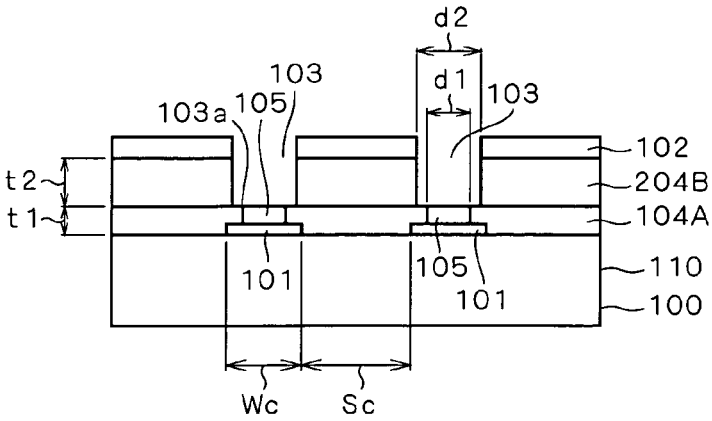
FIGS. 8B and 8C are sectional views taken along the lines A2-A2 and B2-B2 of FIG. 8A, respectively.
Figure 8C:
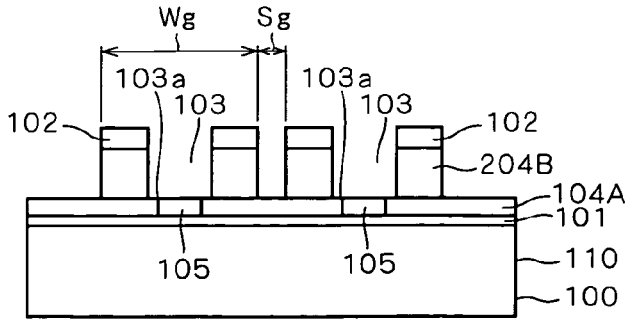

FIG. 8A is an enlarged plan view of an essential part of the cathode substrate 110 of a cold cathode light emitting device according to a second preferred embodiment of the present invention. FIGS. 8B and 8C are sectional views taken along the lines A2-A2 and B2-B2 of FIG. 8A, respectively. The cathode substrate 110 of the cold cathode light emitting device according to the present embodiment substantially differs from that of the first preferred embodiment in the configuration of an insulating layer 204B provided in place of the insulating layer 104B. Thus, the following description will only be directed to the configuration of the insulating layer 204B, and common components with the cathode substrate 110 of the first preferred embodiment are indicated by the same reference characters, explanation of which is thus omitted here.

In the cathode substrate 110 according to the present embodiment, as shown in FIGS. 8A to 8C, the insulating layer 204B near the gate electrodes 102 relative to the other insulating layer 104A has the same pattern configuration as the gate electrodes 102 when viewed from the phosphor display panel 112.

The parameters such as d1, d2, t1, t2 in the present embodiment are set at the same numeric values as those in the first preferred embodiment.

As described, the cold cathode light emitting device of the present embodiment can achieve substantially the same effects as those in the first preferred embodiment, and the pitch between adjacent ones of the gate electrodes 102 is effectively increased. This can prevent shorting of adjacent ones of the gate electrodes 102.

Further, patterning of the gate electrodes 102 and insulating layer 204B and forming of the gate holes 103 can be conducted with a single photolithography process using a photomask for the gate electrodes 102. This can reduce the number of steps, achieving improved productivity.

Third Preferred Embodiment

Figure 9A:
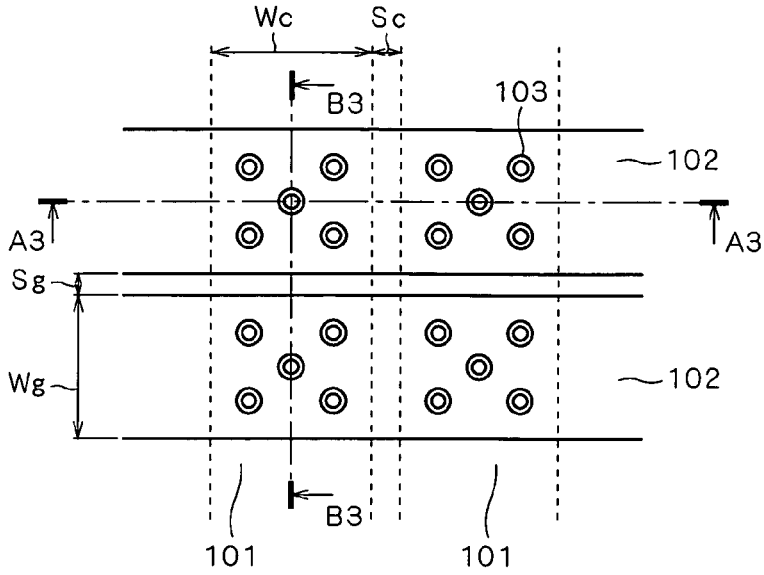
FIG. 9A is an enlarged plan view of an essential part of a cathode substrate of a cold cathode light emitting device according to a third preferred embodiment of the invention.
Figure 9B:
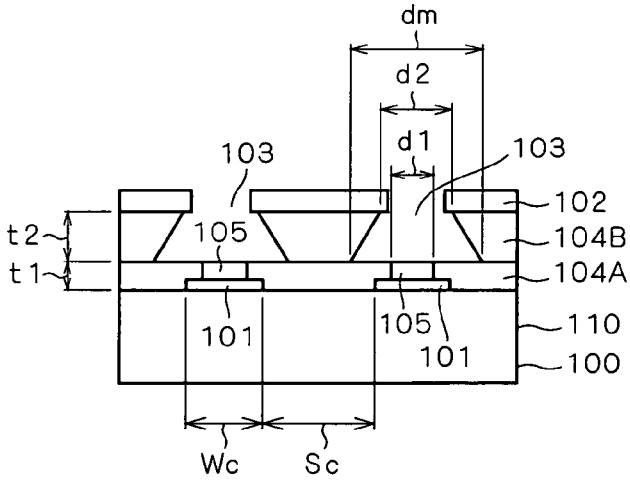
FIGS. 9B and 9C are sectional views taken along the lines A3-A3 and B3-B3 of FIG. 9A, respectively.
Figure 9C:
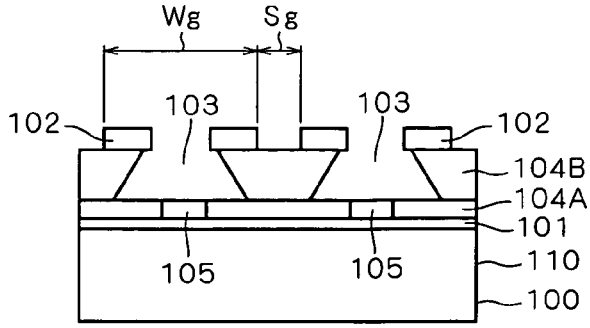

FIG. 9A is an enlarged plan view of an essential part of the cathode substrate 110 of a cold cathode light emitting device according to a third preferred embodiment of the present invention. FIGS. 9B and 9C are sectional views taken along the lines A3-A3 and B3-B3 of FIG. 9A, respectively. The cathode substrate 110 of the cold cathode light emitting device according to the present embodiment substantially differs from that of the first preferred embodiment in the configuration of gate holes 103 and manufacturing steps of the cathode substrate 110. Thus, the following description will only be directed to the differences, and common components with the cathode substrate 110 of the first preferred embodiment are indicated by the same reference characters, explanation of which is thus omitted here.

In the cathode substrate 110 according to the present embodiment, as shown in FIGS. 9A to 9C, the gate holes 103 has the diameter d1 in the first section corresponding to the insulating layer 104A and the diameter d2 at the upper part of the second section corresponding to the insulating layer 104B (where $d2>d1$), and the diameter dm at the lower part of the second section (where $dm>d2$). The diameter of the gate holes 103 in the second section gradually decreases from dm to d2 from the lower surface toward the upper surface of the insulating layer 104B. In the present embodiment, for example, d1, d2 and dm are set at 20 μm, 40 μm and 60 μm, respectively.

Further, in the present embodiment, the insulating layer 104B is formed of a glass paste for insulating layer having photosensitivity. For example, the thickness t1 of the insulating layer 104A is set at 6 μm, and the thickness t2 of the insulating layer 104B is set at 10 μm.

Figure 10:
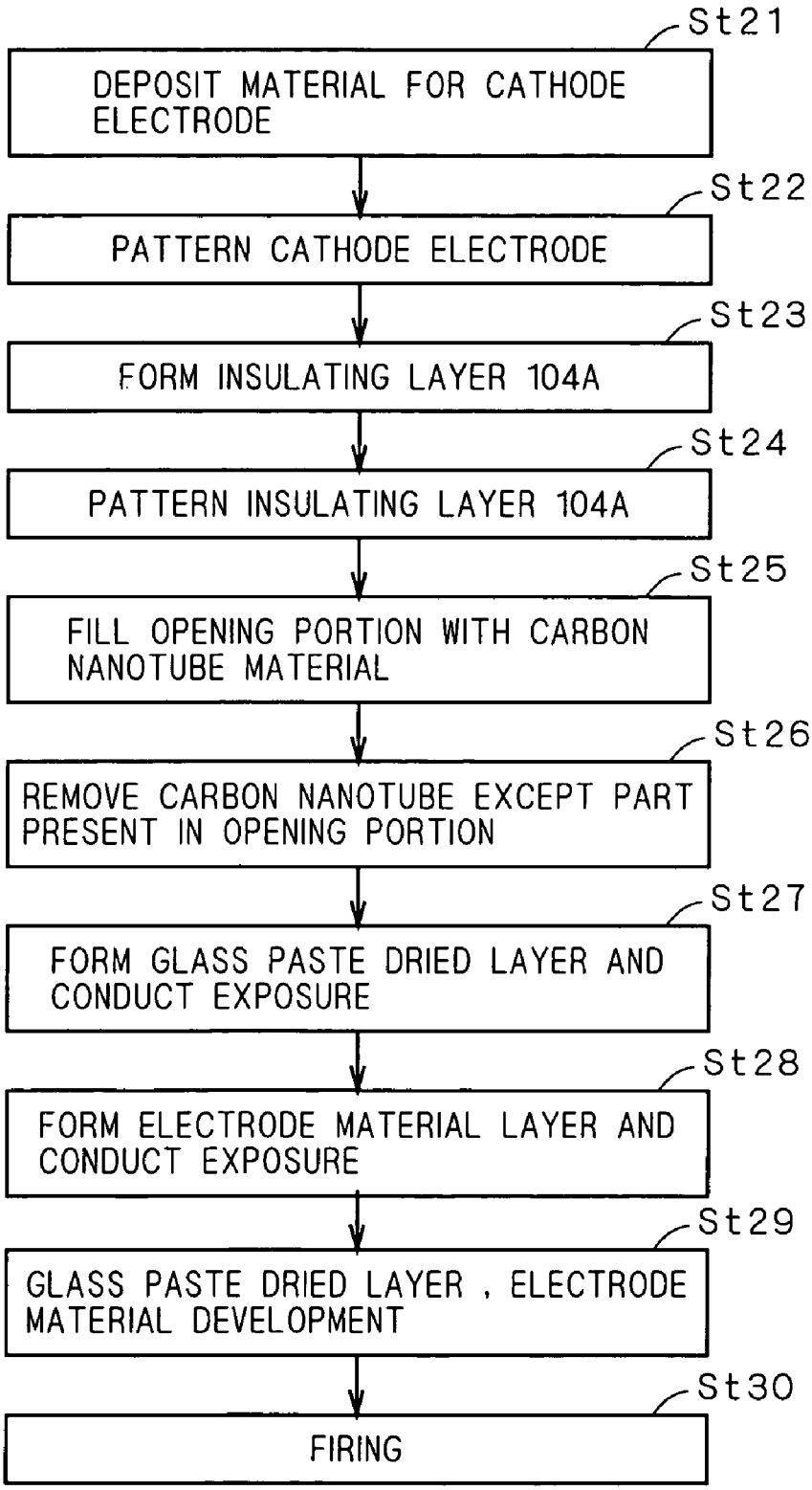
FIG. 10 is a flow chart of manufacturing steps of the cold cathode light emitting device shown in FIGS. 9A to 9C.
Figure 11A:
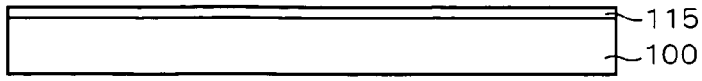
FIGS. 11A through 11G correspond to the cross section taken along the line A3-A3 of FIG. 9A, and show the first half of the manufacturing steps of the cold cathode light emitting device.
Figure 11B:
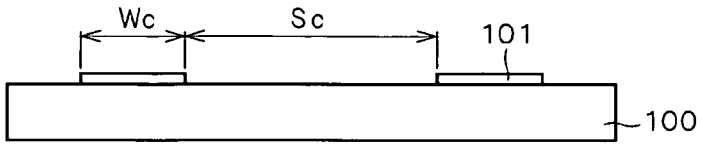
Figure 11C:
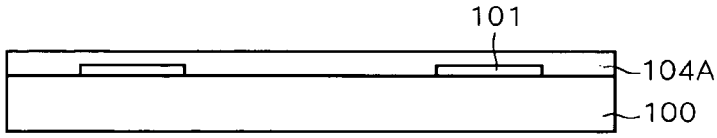
Figure 11D:
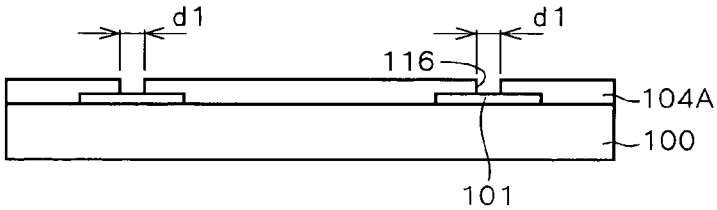
Figure 11E:
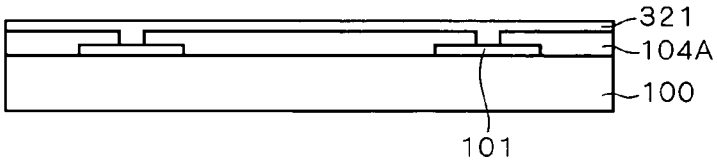
Figure 11F:
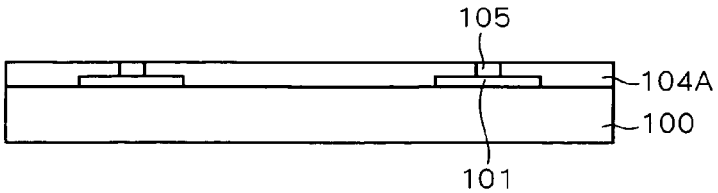
Figure 11G:
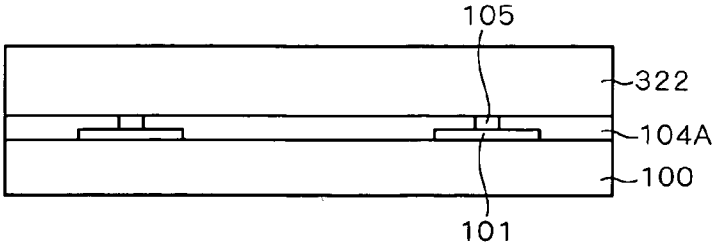
Figure 12A:
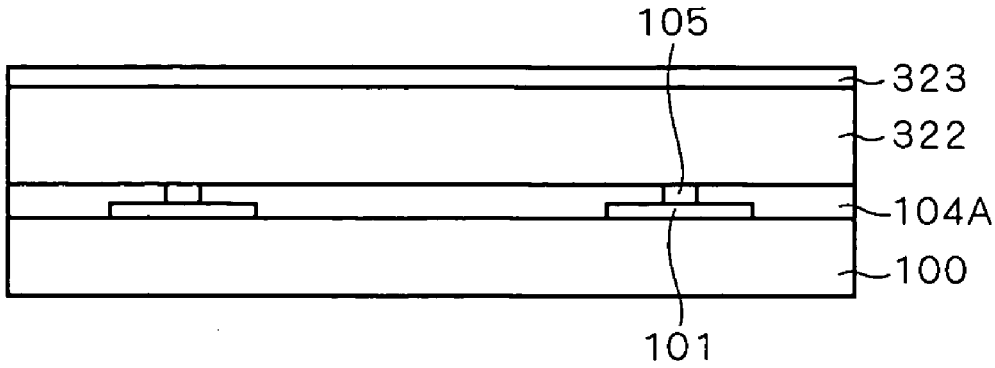
FIGS. 12A and 12B correspond to the cross section taken along the line A3-A3 of FIG. 9A, and show the latter half of the manufacturing steps of the cold cathode light emitting device.
Figure 12B:
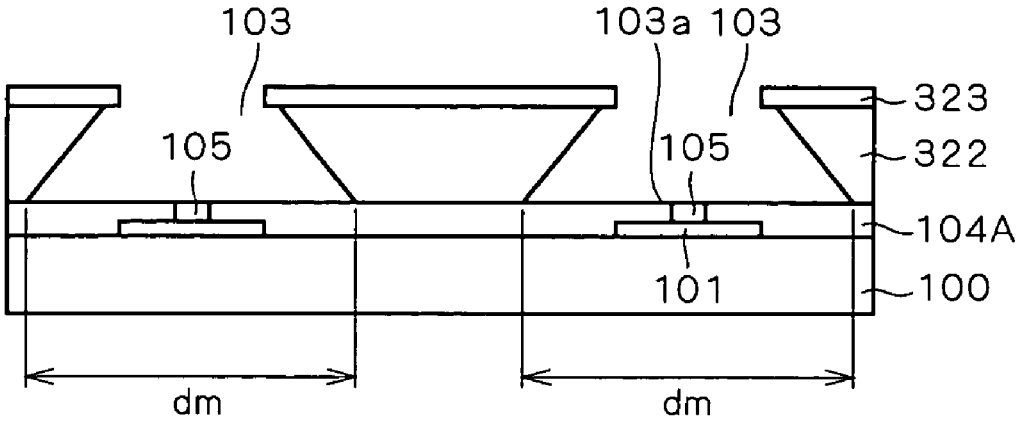
Figure 13A:
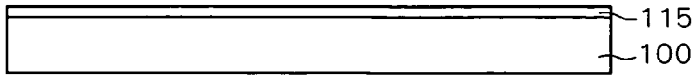
FIGS. 13A through 13G correspond to the cross section taken along the line B3-B3 of FIG. 9A, and show the first half of the manufacturing steps of the cold cathode light emitting device.
Figure 13B:
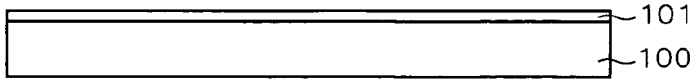
Figure 13C:
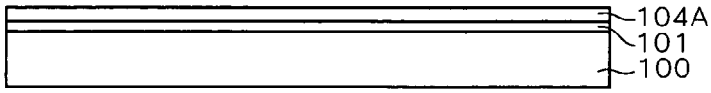
Figure 13D:
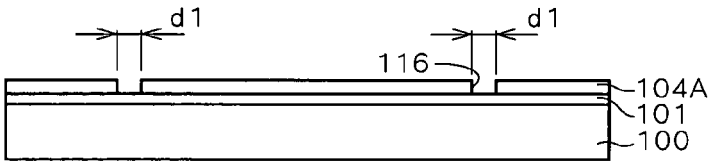
Figure 13E:
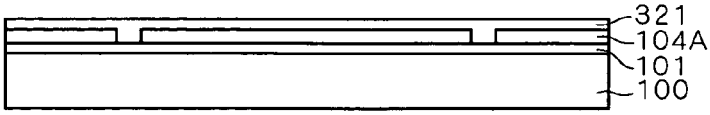
Figure 13F:
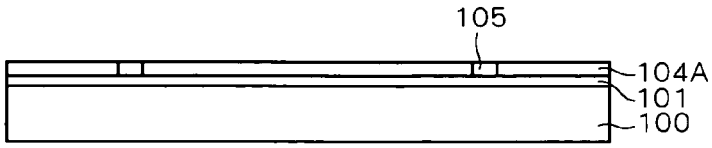
Figure 13G:
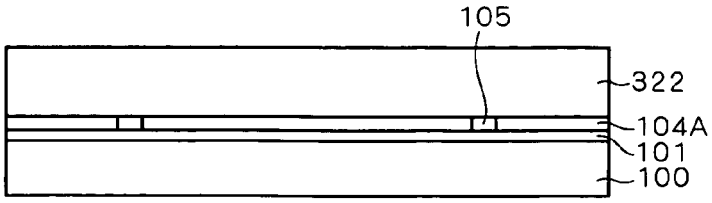
Figure 14A:
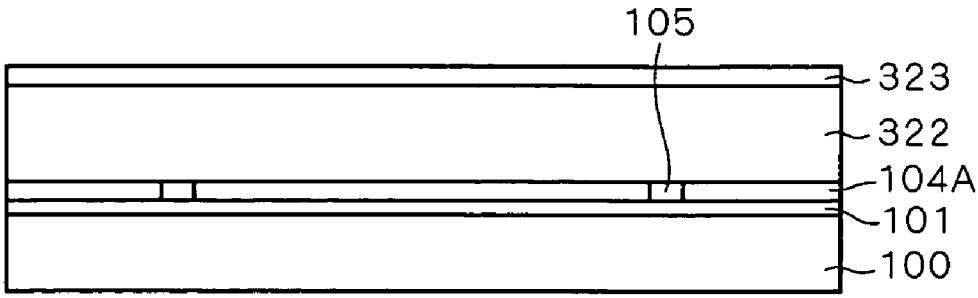
FIGS. 14A and 14B correspond to the cross section taken along the line B3-B3 of FIG. 9A, and show the latter half of the manufacturing steps of the cold cathode light emitting device.
Figure 14B:
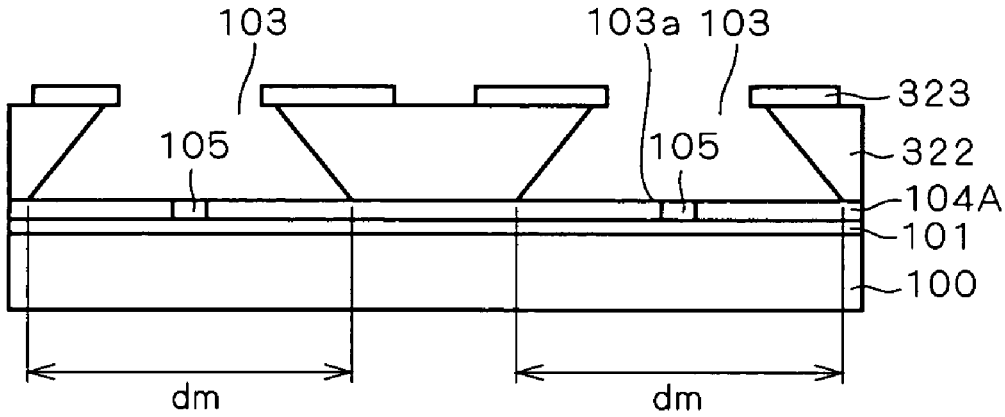

FIG. 10 is a flow chart of manufacturing steps of the cold cathode light emitting device shown in FIGS. 9A to 9C. FIGS. 11A through 11G correspond to the cross section taken along the line A3-A3 of FIG. 9A, and show the first half of the manufacturing steps of the cold cathode light emitting device. FIGS. 12A and 12B correspond to the cross section taken along the line A3-A3 of FIG. 9A, and show the latter half of the manufacturing steps of the cold cathode light emitting device. FIGS. 13A through 13G correspond to the cross section taken along the line B3-B3 of FIG. 9A, and show the first half of the manufacturing steps of the cold cathode light emitting device. FIGS. 14A and 14B correspond to the cross section taken along the line B3-B3 of FIG. 9A, and show the latter half of the manufacturing steps of the cold cathode light emitting device.

First, the metal thin film 115 made of metal, e.g., chromium is formed on the surface of the glass substrate 100 by sputtering or the like (step St21 in FIG. 10; FIGS. 11A and 13A). Next, the metal thin film 115 is selectively removed by a photolithography process, so that the cathode electrodes 101 are formed (step St22 in FIG. 10; FIGS. 11B and 13B).

Subsequently, a glass paste for insulating layer is printed on the whole surface of the glass substrate 100 including the cathode electrodes 101. The printed glass paste layer is dried and then fired. The insulating layer 104A is thereby formed (step St23 in FIG. 10; FIGS. 11C and 13C). Next, the insulating layer 104A is selectively removed by a photolithography process, so that hole portions 116 having the diameter d1 for forming the bottom opening portions 103*a* of the gate holes 103 are formed at a predetermined pitch, e.g., 100 μm (step St24 in FIG. 10; FIGS. 11D and 13D).

Thereafter, a solvent containing CNTs dispersed therein is sprayed at a high pressure onto the whole surface of the glass substrate 100 including the hole portions 116 for coating, and is then dried (step St25 in FIG. 10; FIGS. 11E and 13E). After the CNT-containing solvent is dried, an unnecessary part of a resultant dried film 321 containing the CNTs other than a part thereof present in the hole portions 116 is removed by planarization (step St26 in FIG. 10; FIGS. 11F and 13F). In the present embodiment, the unnecessary part of the dried film 321 is removed by polishing the surface thereof by a polishing tape. The surface polishing is continued until part of the dried film 321 formed on the insulating layer 104A is completely removed so that the upper opening edges of the hole portions 116 become uncovered. Here, the polishing tape is a sheet of film containing polishing particles spread in its surface.

Next, a glass paste for insulating layer having photosensitivity is printed on the whole surface of the nanofiber-structure layer 105 and insulating layer 104A. The printed glass paste layer is dried to form a paste dried layer 322. At this time, the thickness of the dried layer 322 is set at, e.g., 20 μm. Then, the dried layer 322 is exposed to light to form a gate hole pattern (hole diameter: 40 μm, pitch: 100 μm) thereon (step St27 in FIG. 10; FIGS. 11G and 13G).

Subsequently, a conductive silver paste having photosensitivity is printed on the surface of the paste dried layer 322, and is then dried. An electrode material layer 323 is thereby formed, and is thereafter exposed to light through a photomask having a gate hole pattern (hole diameter: 50 μm, pitch: 100 μm) and a stripe pattern (width Wg: 1.01 mm, pitch Sg: 0.1 mm) (step St28 in FIG. 10; FIGS. 12A and 14A).

Thereafter, the paste dried layer 322 and electrode material layer 323, both already subjected to exposure, are developed at the same time (step St29 in FIG. 10; FIGS. 12B and 14B). These layers are then fired at temperatures ranging from 450 to 550° C., for example (step St30 in FIG. 10). The cathode substrate 110 shown in FIGS. 9A to 9C is thereby obtained.

Here, the respective diameters dm and d2 in the second section of the gate holes 103 can be made different to obtain a tapered shape by optimizing exposure-development conditions.

As described, the cold cathode light emitting device according to the present embodiment has substantially the same construction as that of the first preferred embodiment except the configuration of the gate holes 103 in the second section corresponding to the insulating layer 104B, and therefore achieves substantially the same effects as those in the first preferred embodiment.

In the present embodiment, however, the second section of the gate holes 103 gradually decreases in diameter to taper from the diameter dm to diameter d2 (where dm>d2>d1) from the side of the cathode electrodes 101 toward the gate electrodes 102. This can increase the distance between the cathode electrodes 101 and nanofiber-structure layer 105 and the gate electrodes 102, which can prevent shorting of the cathode electrodes 101 and gate electrodes 102 with more reliability.

Further, the stripe pattern and gate hole pattern on the gate electrodes 102 can be formed using a single mask. This can reduce the number of steps, achieving improved productivity.

Fourth Preferred Embodiment

Figure 15A:
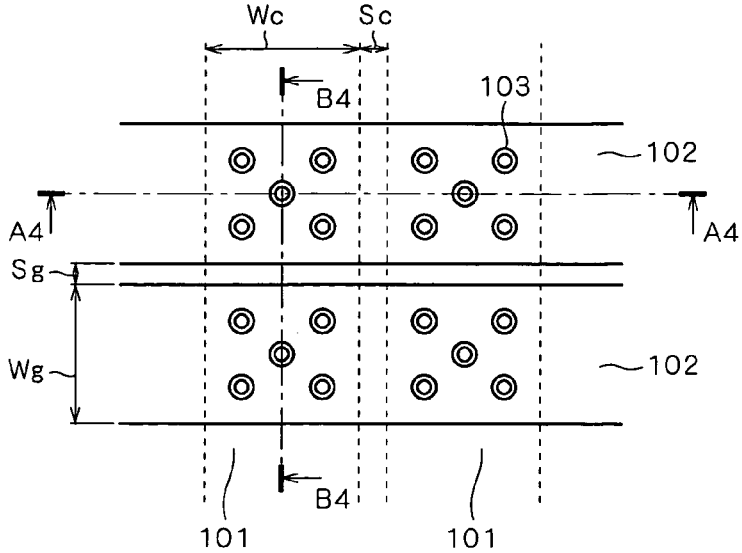
FIG. 15A is an enlarged plan view of an essential part of a cathode substrate of a cold cathode light emitting device according to a fourth preferred embodiment of the invention.
Figure 15B:
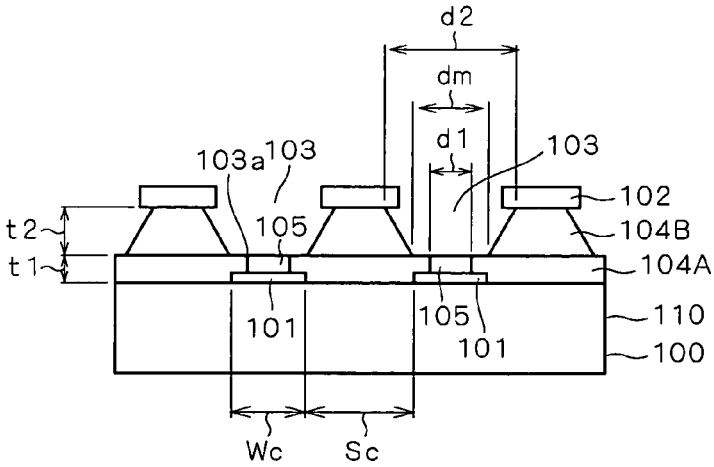
FIGS. 15B and 15C are sectional views taken along the lines A4-A4 and B4-B4 of FIG. 15A, respectively.
Figure 15C:
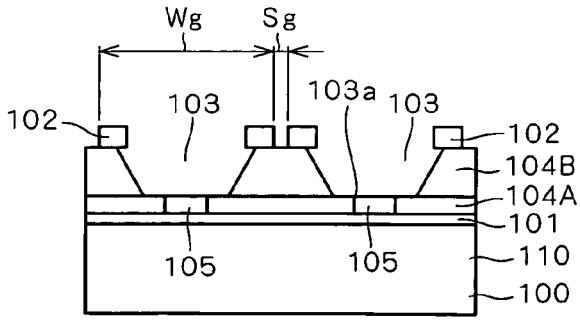

FIG. 15A is an enlarged plan view of an essential part of the cathode substrate 110 of a cold cathode light emitting device according to a fourth preferred embodiment of the present invention. FIGS. 15B and 15C are sectional views taken along the lines A4-A4 and B4-B4 of FIG. 15A, respectively. The cathode substrate 110 of the cold cathode light emitting device according to the present embodiment substantially differs from that of the first preferred embodiment in the configuration of the gate holes 103 and manufacturing steps of the cathode substrate 110. Thus, the following description will only be directed to the differences, and common components with the cathode substrate 110 of the first preferred embodiment are indicated by the same reference characters, explanation of which is thus omitted here.

In the cathode substrate 110 according to the present embodiment, as shown in FIGS. 15A to 15C, the gate holes 103 have the diameter d1 in the first section corresponding to the insulating layer 104A, the diameter d2 at the upper part of the second section corresponding to the insulating layer 104B (where d2>d1), and the diameter dm at the lower part of the second section (where d1<dm<d2). The diameter of the gate holes 103 in the second section gradually increases from dm to d2 from the lower surface toward the upper surface of the insulating layer 104B. In the present embodiment, for example, d1 and d2 are set at 20 μm and 40 μm, respectively.

Further, in the present embodiment, the thickness t1 of the insulating layer 104A is set at 6 μm, and the thickness t2 of the insulating layer 104B is set at 12 μm, for example.

FIGS. 16A through 16G correspond to the cross section taken along the line A4-A4 of FIG. 15A, and show the first half of the manufacturing steps of the cold cathode light emitting device. FIGS. 17A through 17E correspond to the cross section taken along the line A4-A4 of FIG. 15A, and show the latter half of the manufacturing steps of the cold cathode light emitting device. FIGS. 18A through 18G correspond to the cross section taken along the line B4-B4 of FIG. 15A, and show the first half of the manufacturing steps of the cold cathode light emitting device. FIGS. 19A through 19E correspond to the cross section taken along the line B4-B4 of FIG. 15A, and show the latter half of the manufacturing steps of the cold cathode light emitting device.

Figure 16A:
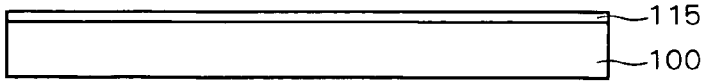
FIGS. 16A through 16G correspond to the cross section taken along the line A4-A4 of FIG. 15A, and show the first half of manufacturing steps of the cold cathode light emitting device.
Figure 16B:
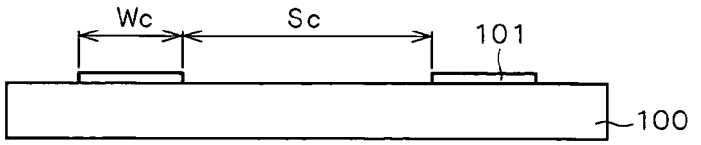
Figure 18A:
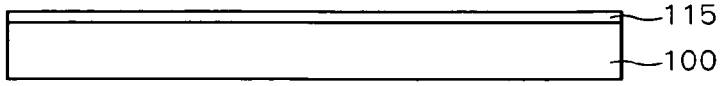
FIGS. 18A through 18G correspond to the cross section taken along the line B4-B4 of FIG. 15A, and show the first half of the manufacturing steps of the cold cathode light emitting device.
Figure 18B:
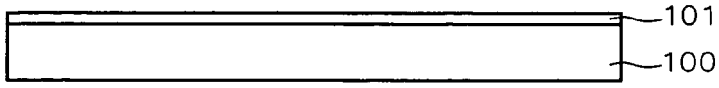

First, the metal thin film 115 made of metal, e.g., chromium is formed on the surface of the glass substrate 100 by sputtering or the like (FIGS. 16A and 18A). Next, the metal thin film 115 is selectively removed by a photolithography process, so that the cathode electrodes 101 are formed (FIGS. 16B and 18B).

Figure 16C:
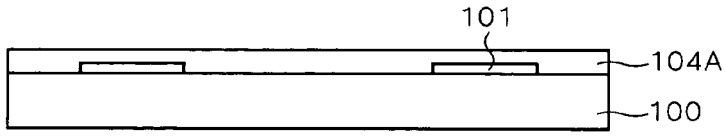
Figure 16D:
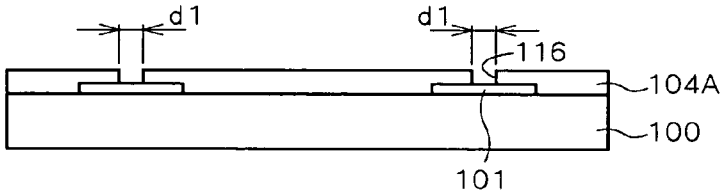
Figure 18C:
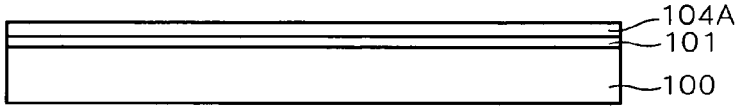
Figure 18D:
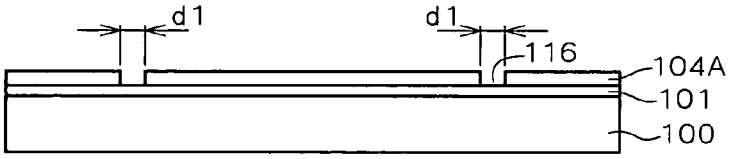

Subsequently, a glass paste for insulating layer is printed on the whole surface of the glass substrate 100 including the cathode electrodes 101. The printed glass paste layer is dried and then fired. The insulating layer 104A is thereby formed (FIGS. 16C and 18C). Next, the insulating layer 104A is selectively removed by a photolithography process, so that the hole portions 116 having the diameter d1 for forming the bottom opening portions 103*a* of the gate holes 103 are formed at a predetermined pitch, e.g., 100 μm (FIGS. 16D and 18D).

Figure 16E:
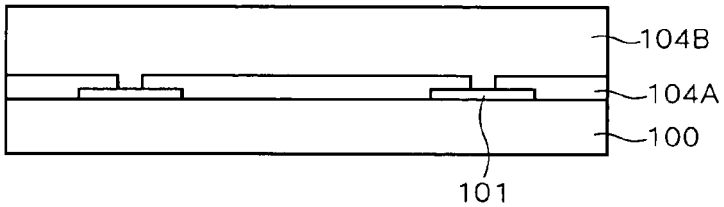
Figure 16F:
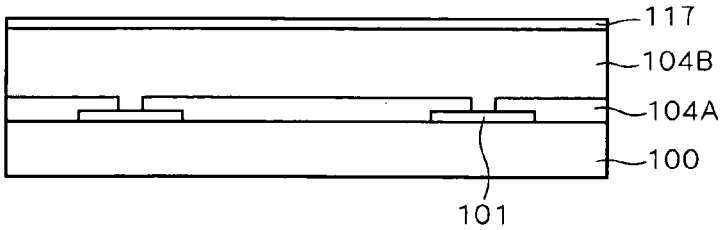
Figure 18E:
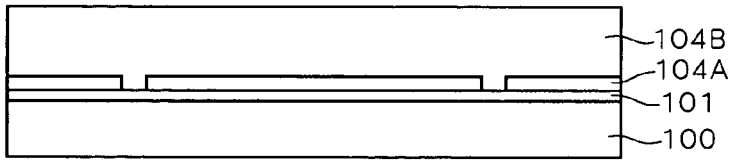
Figure 18F:
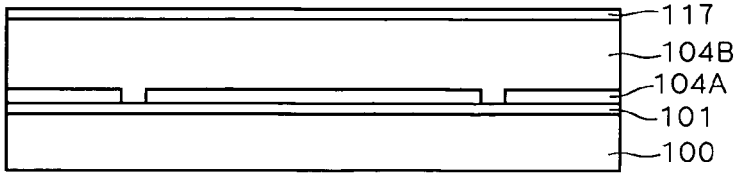

Subsequently, a glass paste for insulating layer is printed on the whole surface of the insulating layer 104A including the hole portions 116. The printed glass paste layer is dried and then fired, so that the insulating layer 104B is formed (FIGS. 16E and 18E).

Figure 16G:
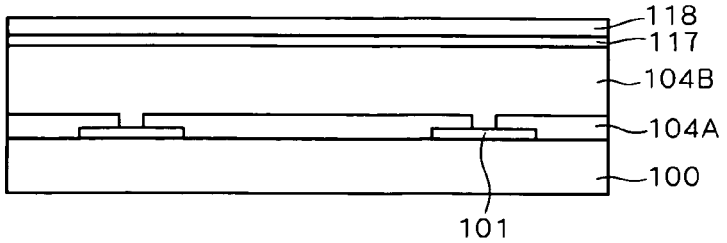
Figure 18G:
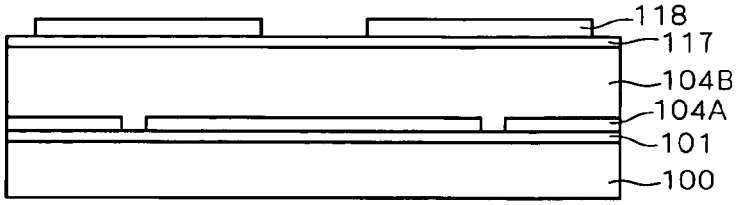

Next, the metal thin film 117 made of metal, e.g., chromium is formed on the surface of the insulating layer 104A by sputtering or the like (FIGS. 16F and 18F), and the metal thin film 117 is selectively removed by a photolithography process. That is, the metal thin film 117 is patterned using the resist pattern 118 formed thereon (FIGS. 16G and 18G). The resist pattern 118 is thereafter removed.

Figure 17A:
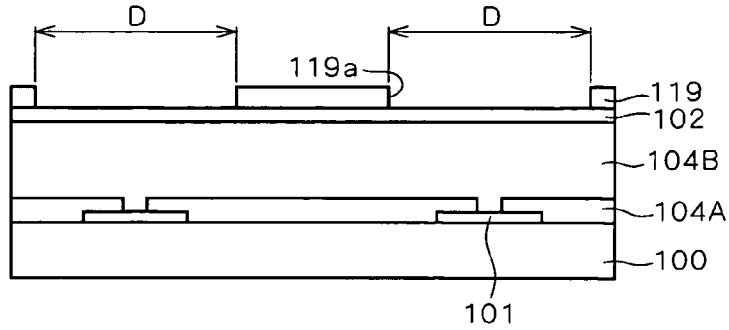
FIGS. 17A through 17E correspond to the cross section taken along the line A4-A4 of FIG. 15A, and show the latter half of the manufacturing steps of the cold cathode light emitting device.
Figure 19A:
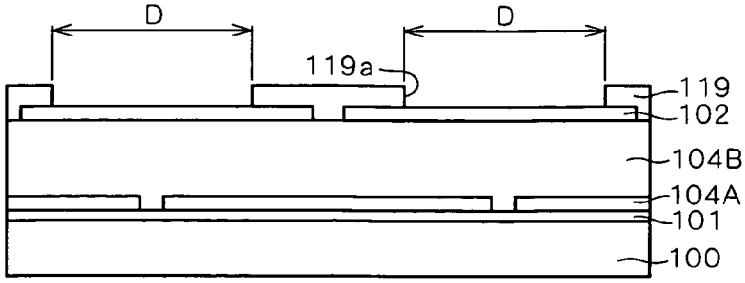
FIGS. 19A through 19E correspond to the cross section taken along the line B4-B4 of FIG. 15A, and show the latter half of the manufacturing steps of the cold cathode light emitting device.

Subsequently, the gate holes 103 are formed. First, the resist pattern 119 for forming gate holes is formed on the surface of the insulating layer 104B with the gate electrodes 102 interposed therebetween using a dry film resist (DFR) (FIGS. 17A and 19A). The resist pattern 119 is used as an etching mask for the gate electrodes 102 and insulating layer 104B, and is provided with hole portions 119*a* having the diameter D for forming the gate holes at predetermined positions. The diameter D of the hole portions 119*a* is set at, e.g., 50 μm, a slightly greater than the diameter (e.g., d2) at the upper opening edges of the gate holes 103 to be formed.

Figure 17B:
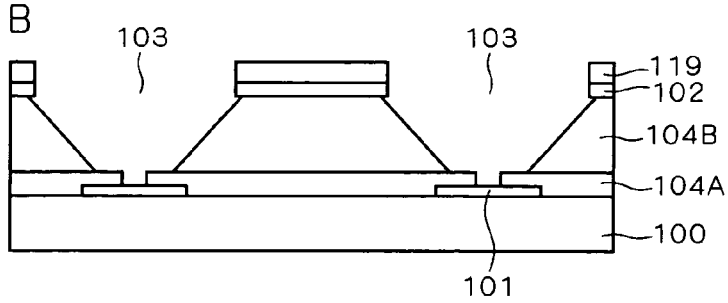
Figure 19B:
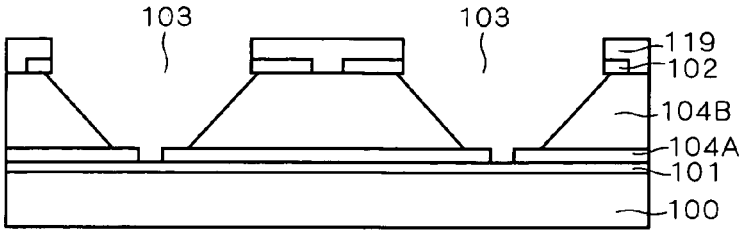

Next, the gate electrodes 102 are subjected to chemical etching with mixed acid through the hole portions 119*a* of the resist pattern 119, and then the insulating layer 104B is subjected to chemical etching with nitric acid. The gate holes 103 are thereby formed to extend to reach the surface of the cathode electrodes 101 (FIGS. 17B and 19B).

Here, the respective diameters dm and d2 in the second section of the gate holes 103 can be made different to obtain a flared shape by optimizing exposure-development conditions.

Figure 17C:
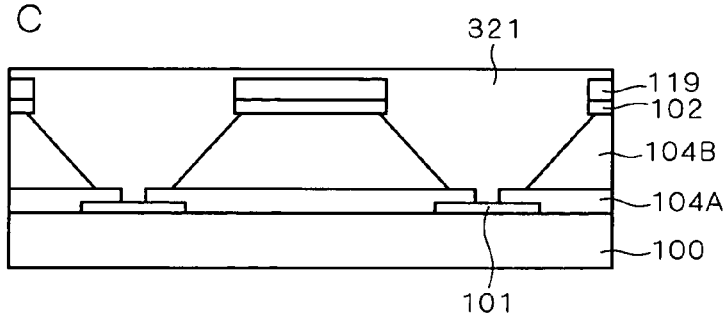
Figure 17D:
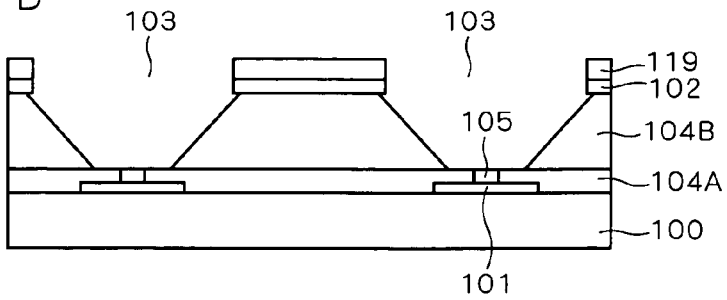
Figure 19C:
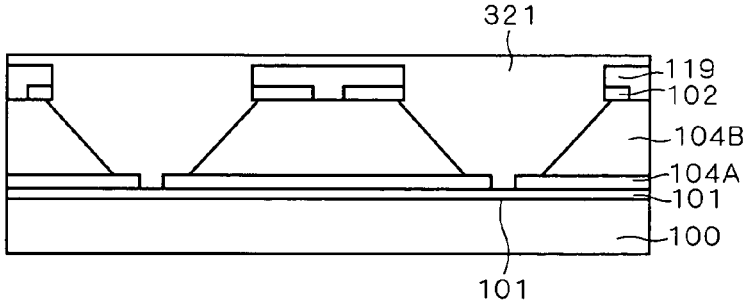
Figure 19D:
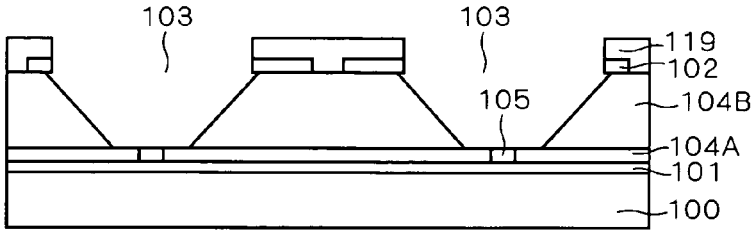

Thereafter, a solvent containing CNTs dispersed therein is sprayed at a high pressure onto the whole surface of the glass substrate 100 including the gate holes 103 for coating, with the resist pattern 119 being left as a sacrificial layer, and is then dried (FIGS. 17C and 19C). After the CNT-containing solvent is dried, an unnecessary part of a resultant dried film 321 containing CNTs other than a part thereof present in the bottom opening portions 103*a* of the gate holes 103 is removed by sand blasting (FIGS. 17D and 19D). That is, part of the dried film 321 remaining in the bottom opening portions 103*a* constitutes the nanofiber-structure layer 105 of nanofiber structure. Specifically, calcium carbonate particles as polishing particles are sprayed at a high pressure onto the surface of the dried film 321. The calcium carbonate particles used here have a particle diameter ds satisfying such a relation with the diameters d1 and d2 of the gate holes 103 that d1<ds<d2. The particle diameter ds ranges between 25 and 30 μm, for example.

Figure 17E:
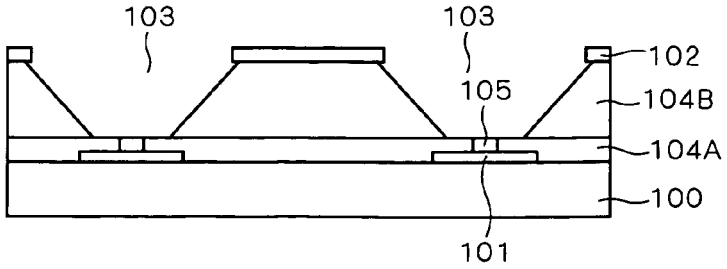
Figure 19E:
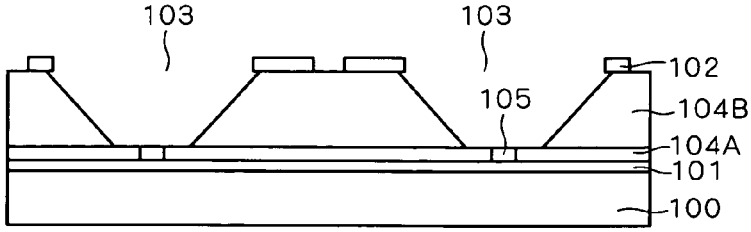

After the unnecessary part of the dried film 321 is removed, the resist pattern 119 used as a sacrificial layer is removed (FIGS. 17E and 19E). Thereafter, the nanofiber-structure layer 105 formed in the gate holes 103 is fired at temperatures ranging from 450 to 550° C., for example, so as to be adhered to the cathode electrode 101. The cathode substrate 110 shown in FIGS. 15A to 15C is thereby obtained.

As described, the cold cathode light emitting device according to the present embodiment has substantially the same construction as that of the first preferred embodiment except the configuration of the gate holes 103 in the second section corresponding to the insulating layer 104B, and therefore achieves substantially the same effects as those in the first preferred embodiment.

In the present embodiment, however, the diameter of the second section of the gate holes 103 gradually increases to flare from dm to d2 (where d2>dm>d1) from the side of the cathode electrodes 101 toward the gate electrodes 102. This can ensure higher insulation between the cathode electrodes 101 and gate electrodes 102. As a result, the thickness t2 of the insulating layer 104B can be made smaller than in the first preferred embodiment, enabling light emission at a lower driving voltage.

Further, the dried film 321 containing CNTs is formed over the resist pattern 119 for forming gate holes being left as a sacrificial layer, and the unnecessary part of the dried film 321 is removed by sand blasting. This can prevent the dried film 321 from adhering to a region, such as the surface of the gate electrodes 102, other than the inner walls of the gate holes 103, and can prevent damage to the gate electrodes 102 by the polishing particles at the removal of the unnecessary part of the dried film 321. Furthermore, since the resist pattern 119 for forming gate holes is used as a sacrificial layer, any specifically dedicated sacrificial layer is not required, which increases efficiency.

Fifth Preferred Embodiment

Figure 20A:
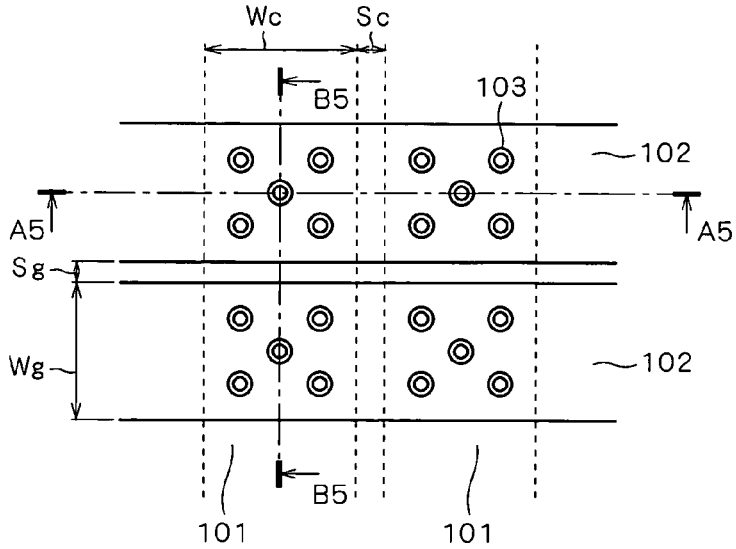
FIG. 20A is an enlarged plan view of an essential part of a cold cathode light emitting device according to a fifth preferred embodiment of the invention.
Figure 20B:
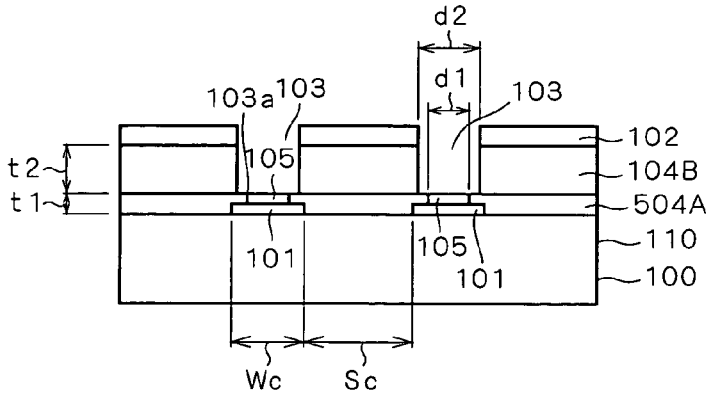
FIGS. 20B and 20C are sectional views taken along the lines A5-A5 and B5-B5 of FIG. 20A, respectively.
Figure 20C:
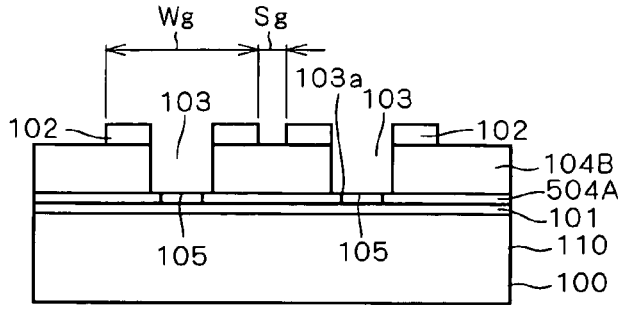

FIG. 20A is an enlarged plan view of an essential part of the cathode substrate 110 of a cold cathode light emitting device according to a fifth preferred embodiment of the present invention. FIGS. 20B and 20C are sectional views taken along the lines A5-A5 and B5-B5 of FIG. 20A, respectively. The cathode substrate 110 of the cold cathode light emitting device according to the present embodiment substantially differs from that of the first preferred embodiment in that the insulating layer 104A is replaced by an insulating layer 504A made of different material formed by a different process. Thus, the following description will only be directed to the differences, and common components with the cathode substrate 110 of the first preferred embodiment are indicated by the same reference characters, explanation of which is thus omitted here.

In the cathode substrate 110 of the present embodiment, as shown in FIGS. 20A to 20C, the insulating layer 504A near the cathode electrodes 101 is formed as a deposited insulating layer in which insulative films are deposited. The deposited insulating layer 504A is formed of oxide insulating films such as $SiO_2$ film and $Al_2O_3$ film with thin-film manufacturing equipment for sputtering, CVD and the like. The thickness t1 of the insulating layer 504A is set at e.g., 2-3 μm, and the thickness t2 of the insulating layer 104B located adjacent to the gate electrodes 102 is set at e.g., 5 μm.

Further, in the present embodiment, the diameter d1 of the bottom opening portions 103*a* of the gate holes 103 is set at e.g., 20 μm, and the diameter d2 of the gate holes 103 at the upper surface of the insulating layer 104B is set at e.g., 60 μm.

FIGS. 21A through 21D correspond to the cross section taken along the line A5-A5 of FIG. 20A, and show part of manufacturing steps of the cold cathode light emitting device. Since the manufacturing steps of the cold cathode light emitting device of the present embodiment bear great similarities to those of the third preferred embodiment, description will be made in reference to the manufacturing steps shown in aforementioned FIG. 10, FIGS. 11A through 11G, FIGS. 12A and 12B, and the like.

Figure 21A:
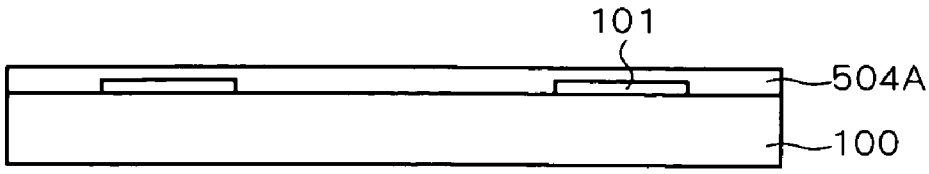
FIGS. 21A through 21D correspond to the cross section taken along the line A5-A5 of FIG. 20A, and show part of manufacturing steps of the cold cathode light emitting device.
Figure 21B:
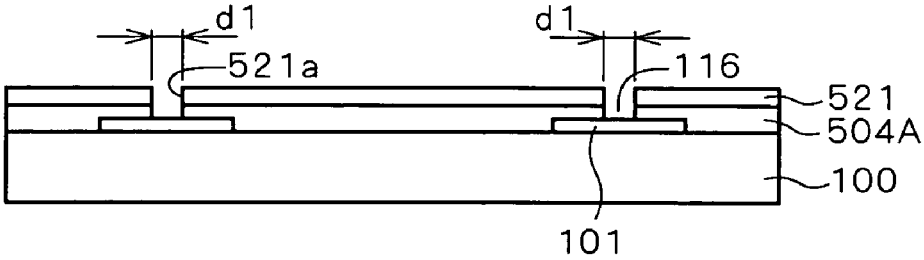

First, similarly to the steps shown in FIGS. 11A and 11B, the metal thin film 115 made of e.g., chromium is formed on the surface of the glass substrate 100, and is patterned. The cathode electrodes 101 are thereby formed. Next, the deposited insulating layer 504A made of $SiO_2$ and the like is formed in the thickness t1 on the whole surface of the glass substrate 100 including the cathode electrodes 101 by sputtering or the like (FIG. 21A).

Subsequently, a resist pattern 521 for generating the hole portions 116 corresponding to the bottom opening portions 103*a* of the gate holes 103 is formed on the whole surface of the insulating layer 504A. With a photolithography process using the resist pattern 521, the hole portions 116 are formed in the deposited insulating layer 504A. Here, the resist pattern 521 is provided with hole portions 521*a* having the diameter d1 of e.g., 20 μm provided at a pitch of 100 μm so as to correspond to the hole portions 116. This resist pattern 521 is not removed but is used as a sacrificial layer in the next step (at formation of a CNT-containing layer).

Figure 21C:
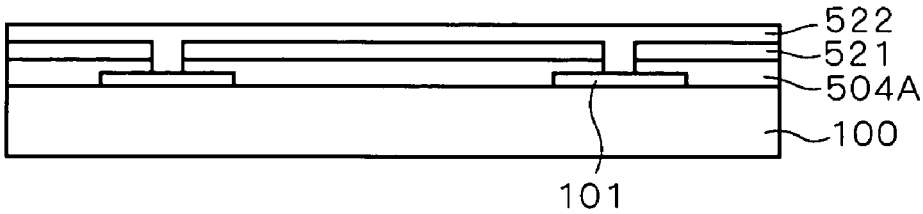

Then, a solvent containing CNTs dispersed therein is sprayed at a high pressure onto the whole surface of the glass substrate 100 including the hole portions 116 for coating with the resist pattern interposed therebetween, and is then dried (FIG. 21C). A dried film 522 containing CNTs is thereby formed on the glass substrate 100.

Figure 21D:
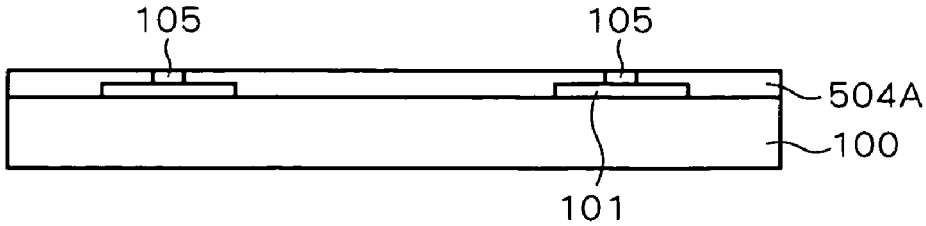

Next, an unnecessary part of the dried film 522 other than a part thereof present in the hole portions 116 and the resist pattern 521 are removed at the same time (FIG. 21D). In this removal process, the processed surface is dipped into a removal solution, so that the resist pattern 521 is removed. Accordingly, the resist pattern 521 and unnecessary part of the dried film 522 are removed at the same time. As a result, only the part of the dried film 522 present in the hole portions 116 in the deposited insulating layer 504A remains, and the remaining part constitutes the nanofiber-structure layer 105 of nanofiber structure.

Subsequently, a glass paste for insulating layer having photosensitivity is printed on the whole surface of the nanofiber-structure layer 105 and deposited insulating layer 504A, and is then dried. A paste dried layer is thereby formed (in a thickness of 10 μm). The paste dried layer is thereafter exposed to light to form a gate hole pattern (hole diameter: 50 μm, pitch: 100 μm) thereon.

Next, a conductive silver paste having photosensitivity is printed on the surface of the paste dried layer, and is then dried. An electrode material layer is thereby formed. Thereafter, the electrode material layer is exposed to light through a photomask having a gate hole pattern (hole diameter: 50 μm, pitch: 100 μm) and a stripe pattern (width Wg: 1.01 mm, pitch Sg: 0.1 mm).

Thereafter, the paste dried layer and electrode material layer, both already subjected to exposure, are developed at the same time by an alkali developing solution (sodium carbonate). Thereafter, these layers are fired at temperatures ranging from 450 to 550° C., for example. The cathode substrate 110 shown in FIGS. 20A to 20C is thereby obtained.

As described, the cold cathode light emitting device according to the present embodiment has substantially the same construction as that of the first preferred embodiment except that the deposited insulating layer 504A is provided in place of the insulating layer 104A, and therefore achieves substantially the same effects as those in the first preferred embodiment.

In the present embodiment, however, the insulating layer 504A located adjacent to the cathode electrodes 101 is a deposited insulating layer in which a $SiO_2$ film and the like are deposited, which can achieve higher insulation between the cathode electrodes 101 and gate electrodes 102 than in the case of the insulating layer 104A formed of fired glass. As a result, the thickness t1 of the insulating layer 504A can be controlled while ensuring insulation between the cathode electrodes 101 and gate electrodes 102, which enables light emission at a lower voltage.

Further, since the insulating layer 504A is formed by depositing films with thin-film manufacturing equipment, the insulating layer 504A can easily be formed thin.

Furthermore, the dried film 522 containing CNTs is formed over the resist pattern 521 for forming the hole portions 116 being left as a sacrificial layer, and the resist pattern 521 is removed together with the unnecessary part of the dried film 522. This can prevent the dried film 522 from adhering to a region other than in the hole portions 116 in the insulating layer 504A. Still further, since the resist pattern 521 is used as a sacrificial layer, any specifically dedicated sacrificial layer is not required, which increases efficiency.

Sixth Preferred Embodiment

Figure 22A:
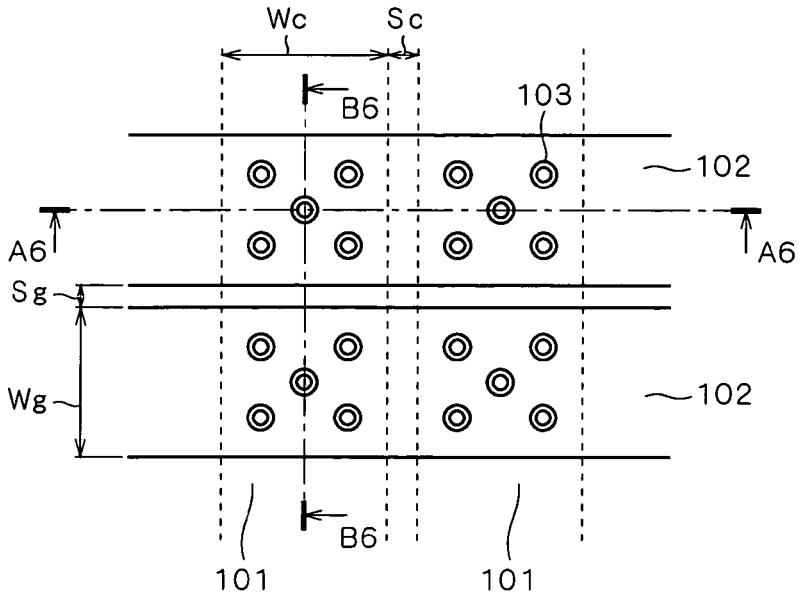
FIG. 22A is an enlarged plan view of an essential part of a cathode substrate of a cold cathode light emitting device according to a sixth preferred embodiment of the invention.
Figure 22B:
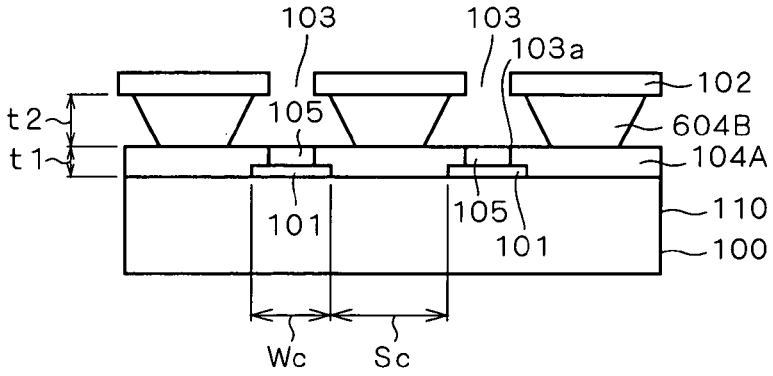
FIGS. 22B and 22C are sectional views taken along the lines A6-A6 and B6-B6 of FIG. 22A, respectively.
Figure 22C:
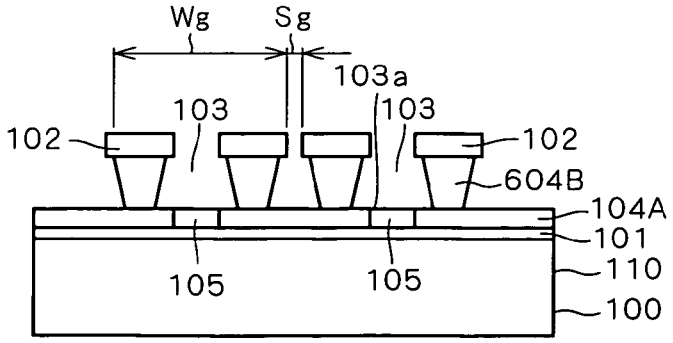

FIG. 22A is an enlarged plan view of an essential part of the cathode substrate 110 of a cold cathode light emitting device according to a sixth preferred embodiment of the present invention. FIGS. 22B and 22C are sectional views taken along the lines A6-A6 and B6-B6 of FIG. 22A, respectively. The cathode substrate 110 of the cold cathode light emitting device according to the present embodiment substantially differs from that of the third preferred embodiment in the configuration of an insulating layer 604B provided in place of the insulating layer 104B. Thus, the following description will only be directed to the configuration of the insulating layer 604B, and common components with the cathode substrate 110 of the third preferred embodiment are indicated by the same reference characters, explanation of which is thus omitted here.

In the cathode substrate 110 of the present embodiment, as shown in FIGS. 22A to 22C, the insulating layer 604B near the gate electrodes 102 relative to the other insulating layer 104A have the same pattern configuration as the gate electrodes 102 as viewed from the phosphor display panel 112.

As described, the cold cathode light emitting device of the present embodiment achieves substantially the same effects as those in the third preferred embodiment, and the pitch between adjacent ones of the gate electrodes 102 is effectively increased. This can prevent shorting of adjacent ones of the gate electrodes 102.

Further, patterning of the gate electrodes 102 and insulating layer 604B and formation of the gate holes 103 can be performed with a single photolithography process using a photomask for the gate electrodes 102. This can reduce the number of steps, achieving improved productivity.

Seventh Preferred Embodiment

Figure 23A:
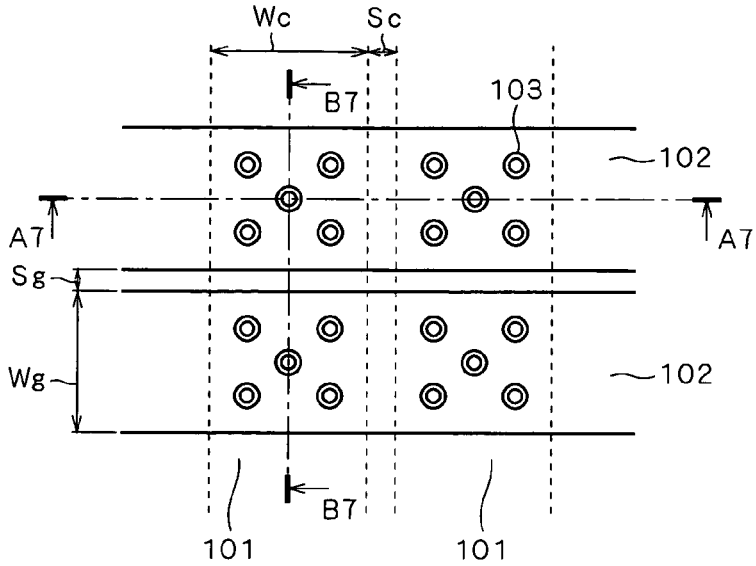
FIG. 23A is an enlarged plan view of an essential part of a cathode substrate of a cold cathode light emitting device according to a seventh preferred embodiment of the invention.
Figure 23B:
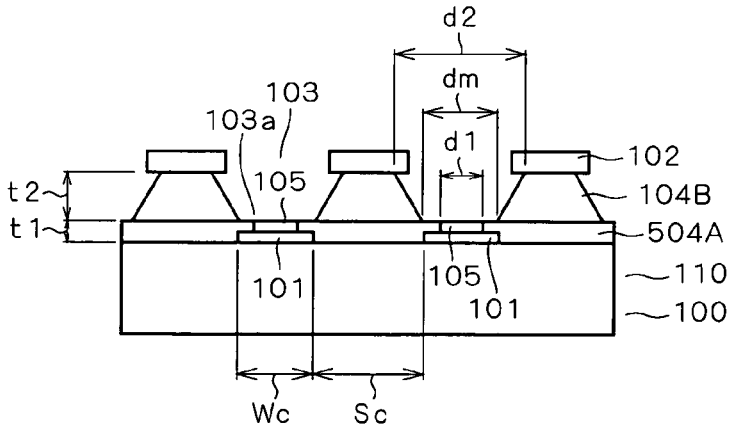
FIGS. 23B and 23C are sectional views taken along the lines A7-A7 and B7-B7 of FIG. 23A, respectively.
Figure 23C:
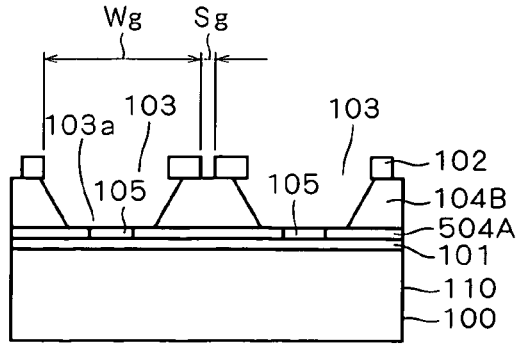

FIG. 23A is an enlarged plan view of an essential part of the cathode substrate 110 of a cold cathode light emitting device according to a seventh preferred embodiment of the present invention. FIGS. 23B and 23C are sectional views taken along the lines A7-A7 and B7-B7 of FIG. 23A, respectively. The cathode substrate 110 of the cold cathode light emitting device according to the present embodiment substantially differs from that of the fifth preferred embodiment in the configuration of the gate holes 103. Thus, the following description will only be directed to the difference, and common components with the cathode substrate 110 of the first preferred embodiment are indicated by the same reference characters, explanation of which is thus omitted here.

In the cathode substrate 110 according to the present embodiment, as shown in FIGS. 23A to 23C, the diameter of the gate holes 103 in the second section corresponding to the insulating layer 104B increases upwardly substantially similarly to the case in the fourth preferred embodiment. That is, the gate holes 103 have the diameter d1 in the first section corresponding to the insulating layer 504A, the diameter d2 at the upper part of the second section corresponding to the insulating layer 104B (where d2>d1), and the diameter dm at the lower part of the second section (where d1<dm<d2).

As described, the cold cathode light emitting device according to the present embodiment has substantially the same construction as that of the fifth preferred embodiment except the configuration of the gate holes 103 in the second section corresponding to the insulating layer 104B, and therefore achieves substantially the same effects as those in the fifth preferred embodiment.

In the present embodiment, however, the gate holes 103 in the second section gradually increases in diameter upwardly, which achieves higher insulation between the cathode electrodes 101 and gate electrodes 102. As a result, the thickness t2 of the insulating layer 104B can be made smaller than in the first preferred embodiment. This enables light emission at a lower driving voltage.

Particularly in the present embodiment, the combined effect of upward increase in diameter in the second section of the gate holes 103 and the deposited insulating layer 504A having a higher dielectric strength than a fired glass layer can achieve higher insulation between the cathode electrodes 101 and gate electrodes 102 and can reduce the thickness t2 of the insulating layer 104B. This enables light emission at a lower driving voltage.

Eighth Preferred Embodiment

Figure 24A:
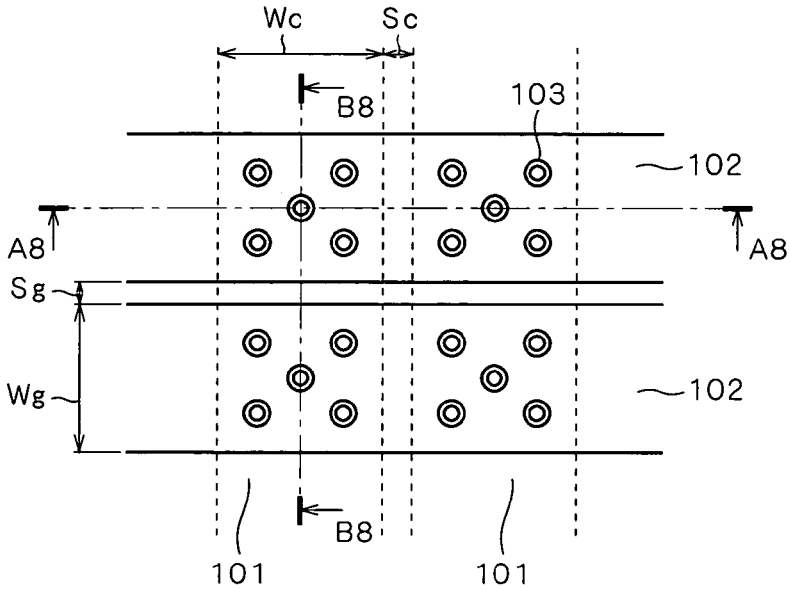
FIG. 24A is an enlarged plan view of an essential part of a cathode substrate of a cold cathode light emitting device according to an eighth preferred embodiment of the invention.
Figure 24B:
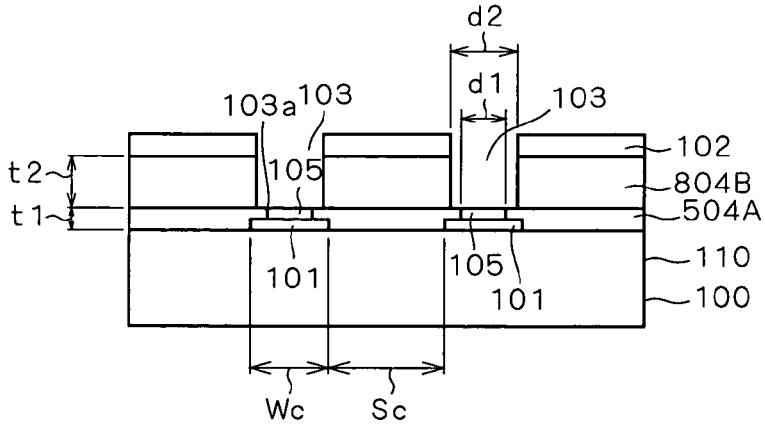
FIGS. 24B and 24C are sectional views taken along the lines A8-A8 and B8-B8 of FIG. 24A, respectively.
Figure 24C:
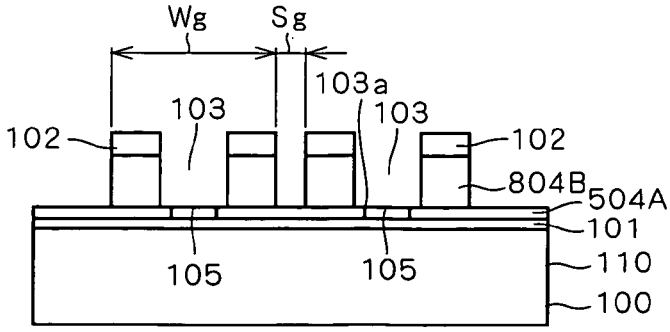

FIG. 24A is an enlarged plan view of an essential part of the cathode substrate 110 of a cold cathode light emitting device according to an eighth preferred embodiment of the present invention. FIGS. 24B and 24C are sectional views taken along the lines A8-A8 and B8-B8 of FIG. 24A, respectively. The cathode substrate 110 of the cold cathode light emitting device according to the present embodiment substantially differs from that of the fifth preferred embodiment in the configuration of an insulating layer 804B provided in place of the insulating layer 104B. Thus, the following description will only be directed to the configuration of the insulating layer 804B, and common components with the cathode substrate 110 of the fifth preferred embodiment are indicated by the same reference characters, explanation of which is thus omitted here.

In the cathode substrate 110 of the present embodiment, as shown in FIGS. 24A to 24C, the insulating layer 804B near the gate electrodes 102 relative to the other insulating layer 504A have the same pattern configuration as the gate electrodes 102 when viewed from the phosphor display panel 112.

As described, the cold cathode light emitting device of the present embodiment achieves substantially the same effects as those in the fifth preferred embodiment, and the pitch between adjacent ones of the gate electrodes 102 is effectively increased. This can prevent shorting of adjacent ones of the gate electrodes 102.

Further, patterning of the gate electrodes 102 and insulating layer 804B and formation of the gate holes 103 can be performed with a single photolithography process using a photomask for the gate electrodes 102. This can reduce the number of steps, achieving improved productivity.

While the invention has been shown and described in detail, the foregoing description is in all aspects illustrative and not restrictive. It is therefore understood that numerous modifications and variations can be devised without departing from the scope of the invention.

What is claimed is:

1. A cold cathode light emitting device emitting light by electrons extracted from a cold cathode, comprising:

a plurality of cathode electrodes;

a plurality of insulating layers laminated over said plurality of cathode electrodes;

a plurality of gate electrodes provided on said plurality of insulating layers to intersect said plurality of cathode electrodes with said plurality of insulating layers interposed therebetween, for extracting electrons from said plurality of cathode electrodes;

an anode electrode opposed to said plurality of gate electrodes for emitting light upon receipt of said electrons, with a voltage for accelerating said electrons being applied between said anode electrode and said plurality of cathode electrodes;

at least one hole provided at each intersection of said plurality of cathode electrodes and said plurality of gate electrodes extending through said plurality of gate electrodes and said plurality of insulating layers to reach a surface of said plurality of cathode electrodes, said at least one hole having a first diameter at a position where a first of said plurality of insulating layers contacts said plurality of cathode electrodes and a second diameter at a position of said plurality of gate electrodes, where the second diameter is greater than the first diameter; and a nanofiber-structure layer provided on said plurality of cathode electrodes in an opening portion corresponding to said first diameter in said at least one hole, wherein said at least one hole is divided into a first section corresponding to a lowermost insulating layer of said plurality of insulating layers being in contact with said plurality of cathode electrodes, a second section corresponding to the remainder of said plurality of insulating layers located over said lowermost insulating layer, and a third section corresponding to said plurality of gate electrodes; and said first diameter is in said first section, and said second section includes a diameter which decreases to taper toward said plurality of gate electrodes.

2. A cold cathode light emitting device emitting light by electrons extracted from a cold cathode, comprising:

a plurality of cathode electrodes;

a plurality of insulating layers laminated over said plurality of cathode electrodes;

a plurality of gate electrodes provided on said plurality of insulating layers to intersect said plurality of cathode electrodes with said plurality of insulating layers interposed therebetween, for extracting electrons from said plurality of cathode electrodes;

an anode electrode opposed to said plurality of gate electrodes for emitting light upon receipt of said electrons, with a voltage for accelerating said electrons being applied between said anode electrode and said plurality of cathode electrodes;

at least one hole provided at each intersection of said plurality of cathode electrodes and said plurality of gate electrodes extending through said plurality of gate electrodes and said plurality of insulating layers to reach a surface of said plurality of cathode electrodes, said at least one hole having a first diameter at a position where a first of said plurality of insulating layers contacts said plurality of cathode electrodes and a second diameter at a position of said plurality of gate electrodes, where the second diameter is greater than the first diameter; and a nanofiber-structure layer provided on said plurality of cathode electrodes in an opening portion corresponding to said first diameter in said at least one hole, wherein said plurality of insulating layers are each formed by firing a paste material made of resin containing glass powder dispersed therein, and a softening point of said glass powder used for said plurality of insulating layers decreases in the order of getting closer to said plurality of gate electrodes.

3. A cold cathode light emitting device emitting light by electrons extracted from a cold cathode, comprising:

a plurality of first electrodes;

a plurality of insulating layers laminated in said plurality of first electrodes;

a plurality of second electrodes provided on said plurality of insulating layers to intersect said plurality of first electrodes with said plurality of insulating layers interposed therebetween, for extracting electrons from said plurality of first electrodes; and a third electrode opposed to said plurality of second electrodes for emitting light upon receipt of said electrons, with a voltage for accelerating said electrons being applied between said third electrode and said plurality of first electrodes, wherein at least one hole is provided at intersections of said plurality of first electrodes and said plurality of second electrodes to extend through said plurality of second electrodes and said plurality of insulating layers to reach a surface of said plurality of first electrodes, said at least one hole has a first diameter d1 at a position where said plurality of insulating layers are in contact with said plurality of first electrodes and a second diameter d2 at a position where said plurality of insulating layers are in contact with said plurality of second electrodes, where d2 is greater than d1, a nanofiber-structure layer is provided on said plurality of first electrodes in an opening portion having said first diameter d1 in said at least one hole, said plurality of insulating layers are each formed by firing a paste material made of resin containing glass powder dispersed therein, and a softening point of said glass powder used for said plurality of insulating layers decreases in the order of getting closer to said plurality of second electrodes.

* * * * *